US012484745B2

(12) United States Patent
Wesley

(10) Patent No.: US 12,484,745 B2
(45) Date of Patent: Dec. 2, 2025

(54) HANDHELD EXTRACTION CLEANER WITH LIQUID MOVEMENT MITIGATION

(71) Applicant: BISSELL Inc., Grand Rapids, MI (US)

(72) Inventor: Mitchell J. Wesley, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 348 days.

(21) Appl. No.: 18/303,301

(22) Filed: Apr. 19, 2023

(65) Prior Publication Data

US 2023/0355051 A1 Nov. 9, 2023

Related U.S. Application Data

(60) Provisional application No. 63/339,661, filed on May 9, 2022.

(51) Int. Cl.

| | |
|---|---|
| ***A47L 7/00*** | (2006.01) |
| ***A47L 5/24*** | (2006.01) |
| ***A47L 9/28*** | (2006.01) |
| ***A47L 11/34*** | (2006.01) |
| ***A47L 11/40*** | (2006.01) |

(52) U.S. Cl.

CPC ..... *A47L 7/0014* (2013.01); *A47L 5/24* (2013.01); *A47L 7/0023* (2013.01); *A47L 7/0028* (2013.01); *A47L 9/2805* (2013.01); *A47L 9/2836* (2013.01); *A47L 11/34* (2013.01); *A47L 11/4011* (2013.01); *A47L 11/4016* (2013.01)

(58) Field of Classification Search

CPC .... A47L 7/0042; A47L 7/0009; A47L 7/0023; A47L 11/4044; A47L 5/24

See application file for complete search history.

(56) References Cited

U.S. PATENT DOCUMENTS 6,125,498 A * 10/2000 Roberts ..... A47L 9/0027 15/352
6,968,593 B1 11/2005 Lenkiewicz et al.
2015/0208886 A1 7/2015 Fischer

FOREIGN PATENT DOCUMENTS

CN 105078358 A 11/2015
CN 106308683 A 1/2017
(Continued)

OTHER PUBLICATIONS

European Patent Office, Communication of A Notice of Opposition to European Patent No. EP4275564, May 31, 2025, Munich Germany.

*Primary Examiner* — Shay Karls
(74) *Attorney, Agent, or Firm* — Quinn IP Law

(57) ABSTRACT

An extraction cleaner includes a suction nozzle having an inlet path and suction fan configured to provide suction. The inlet path brings liquid and air into the extraction cleaner. Suction fan has a fan entrance, a recovery tank is spaced from the fan entrance. A separator element configured to allow liquid to flow into the recovery tank, inhibit the flow of liquid out of the recovery tank, and inhibit liquid from reaching the fan entrance, or all three. The separator element may be a butterfly valve configured to selectively close the fan entrance. The separator element may be a funnel extending into the recovery tank to block liquid from leaving the recovery tank during inversion. The separator element may be a fan separator adjacent the suction fan, which directs liquid outward, away from the fan separator, within the extraction cleaner, such that liquid is moved away from the suction fan.

18 Claims, 16 Drawing Sheets

(56) References Cited

FOREIGN PATENT DOCUMENTS

| | | | | | |
|---|---|---|---|---|---|
| CN | 107581967 | A | | 1/2018 | |
| EP | 2644072 | A2 | | 10/2013 | |
| ES | 2348006 | T3 | * | 11/2010 | ..... A47L 13/22 |
| FR | 3004328 | A1 | | 10/2014 | |
| GB | 2430354 | A | * | 3/2007 | ..... A47L 11/34 |
| WO | 2017108090 | A1 | | 6/2017 | |

* cited by examiner

HANDHELD EXTRACTION CLEANER WITH LIQUID MOVEMENT MITIGATION

CROSS-REFERENCE TO RELATED APPLICATIONS

This application claims the benefit of U.S. Provisional Application No. 63/339,661, filed May 9, 2022, which is hereby incorporated by reference in its entirety.

TECHNICAL FIELD

The present disclosure generally relates to handheld extraction cleaners and inhibition of liquid movement within handheld extraction cleaners.

BACKGROUND

Handheld extraction cleaners, such as those used to clean up after pets, may be used to clean carpets or other soft surfaces, including vehicle interiors, upholstery, and rugs, in addition to other surfaces. A cleaning fluid or solution may be kept or stored onboard the handheld extraction cleaner and may be applied to assist in cleaning the target area. The handheld extraction cleaner can include a suction source that extracts dispensed cleaning fluid and/or debris from the surface and into a recovery tank carried by the cleaner.

BRIEF SUMMARY

A handheld extraction cleaner is provided. The extraction cleaner includes a suction nozzle defining an inlet path and a brush element disposed adjacent one end of the inlet path. A suction fan is configured to provide suction to an opposite end of the inlet path from the brush element, such that the inlet path brings liquid and air into the handheld extraction cleaner.

A vacuum motor is operatively driving the suction fan. The suction fan has a fan entrance, and a recovery tank has a tank inlet spaced from the fan entrance. A separator element configured to allow liquid to flow into the recovery tank, inhibit the flow of liquid out of the recovery tank, and inhibit liquid from reaching the fan entrance, or all three.

In some configurations, the separator element is a funnel located at the tank inlet of the recovery tank. The funnel extends from the tank inlet into the recovery tank, such that the funnel blocks liquid from leaving the recovery tank during operation outside of an operating zone range or partial inversion of the handheld extraction cleaner. Some configurations may include a check valve within the funnel, such that the check valve is configured to close and inhibit flow from the recovery tank when the handheld extraction cleaner is outside of an operating zone range and is configured to open, and allow flow into the recovery tank, when the handheld extraction cleaner is within the operating zone range. Options for the check valve include a ball valve or a flapper valve.

In some configurations, the separator element is a fan separator adjacent the suction fan. The fan separator is configured to direct liquid outward, away from the fan separator, within the handheld extraction cleaner, such that liquid is moved away from the suction fan. The fan separator and the suction fan may be commonly driven by the vacuum motor. The fan separator may also include a funnel located at the tank inlet of the recovery tank, such that the funnel extends from the tank inlet into the recovery tank and blocks liquid from leaving the recovery tank during operation outside of an operating zone range of the handheld extraction cleaner.

In some configurations, the separator element is a butterfly valve configured to selectively close the fan entrance. An orientation sensor may be configured to sense an angle of the handheld extraction cleaner. The orientation sensor is configured to close the butterfly valve when the sensed angle is outside of an operating zone range and is configured to open the butterfly valve when the sensed angle is within the operating zone range. The butterfly valve may also include a funnel located at the tank inlet of the recovery tank, such that the funnel extends from the tank inlet into the recovery tank and blocks liquid from leaving the recovery tank during operation outside of an operating zone range of the handheld extraction cleaner.

BRIEF DESCRIPTION OF THE DRAWINGS

The drawings described herein are for illustrative purposes only, are schematic in nature, and are intended to be exemplary rather than to limit the scope of the disclosure.

The above features and advantages and other features and advantages of the present teachings are readily apparent from the following detailed description of the modes for carrying out the present teachings when taken in connection with the accompanying drawings. It should be understood that even though in the figures embodiments may be separately described, single features thereof may be combined to additional embodiments.

DETAILED DESCRIPTION

Figure 1:
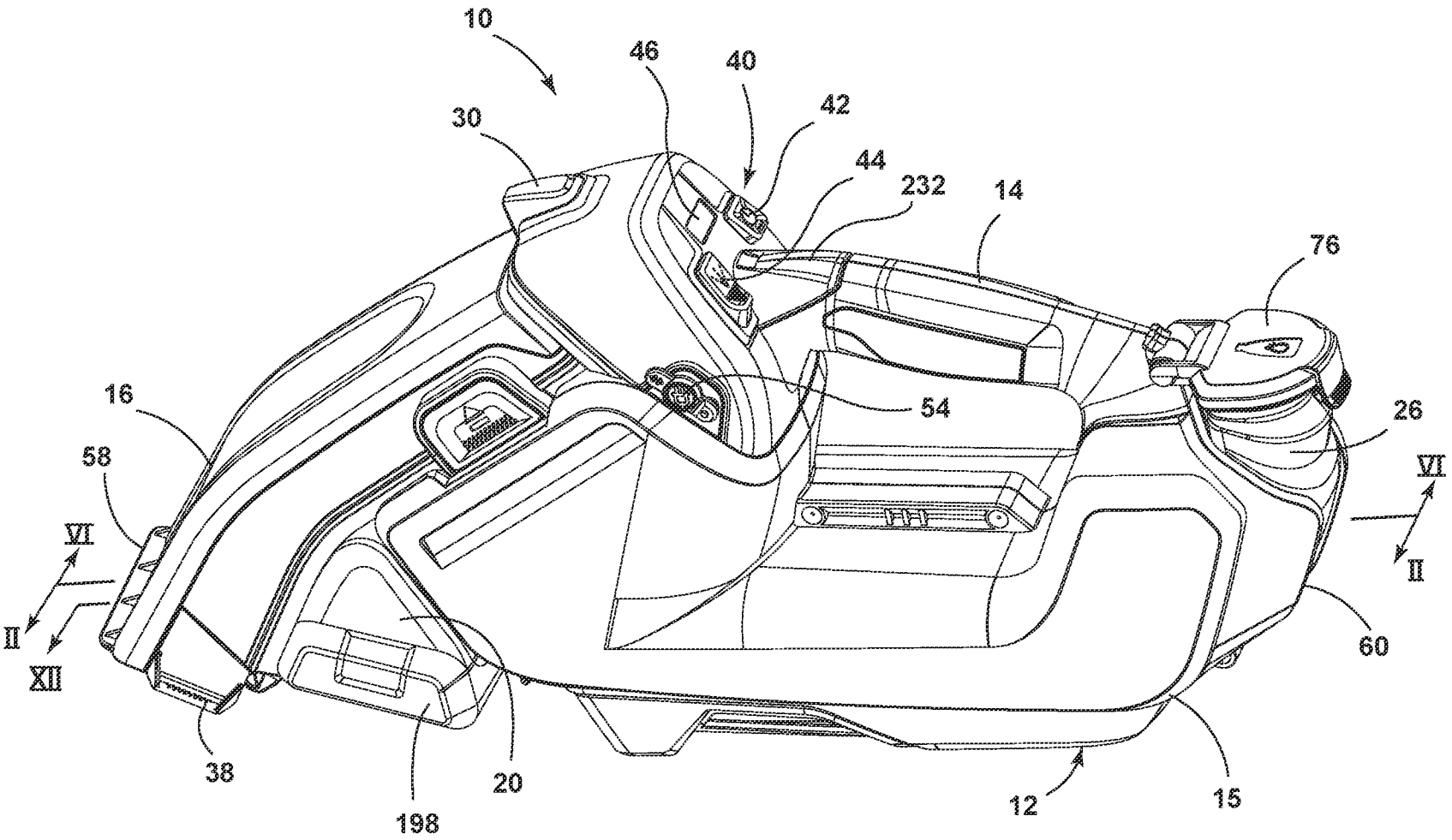
FIG. 1 is a perspective view of a handheld extraction cleaner according to one aspect of the disclosure.

Referring to the drawings, like reference numbers refer to similar components, wherever possible. All figure descriptions simultaneously refer to all other figures. FIG. 1 is a perspective view of a handheld or hand-carriable extraction cleaner 10, which may be referred to simply as cleaner 10, according to one embodiment of the disclosure. The handheld extraction cleaner 10 can have a unitary body 12, or simply body 12, provided with a carry handle 14 attached to the unitary body 12, and is small enough to be transported by one user to the area to be cleaned.

For purposes of description related to the figures, the terms "upper," "lower," "right," "left," "rear," "front," "vertical," "horizontal," "inner," "outer," and derivatives thereof shall relate to the extraction cleaner 10 as oriented in FIG. 1 from the perspective of a user behind the extraction cleaner 10, which defines a rear end of the extraction cleaner 10, and carrying the extraction cleaner 10 by the handle 14, which defines an upper end of the extraction cleaner 10. When used in referring to a direction, the term "longitudinal" refers to a direction generally extending along the length of the extraction cleaner 10, between a forward end 58 and a rearward end 60 of a housing 15, and the terms "transverse" or "lateral" refer to a direction generally perpendicular to the longitudinal direction. However, it is to be understood that the disclosure may assume various alternative orientations, except where expressly specified to the contrary, and directional terms should not be interpreted to limit the disclosure to any specific orientation.

The unitary body 12 can include the housing 15 that carries various components and functional systems of the extraction cleaner 10, including a fluid delivery system for storing cleaning fluid and delivering the cleaning fluid to the surface to be cleaned and a recovery system removing the spent cleaning fluid and debris from the surface to be cleaned and storing the spent cleaning fluid and debris. In being carried by the unitary body 12 or housing 15, the various components and functional systems are conveyed along with the unitary body 12 as it is transported by the user to or from an area to be cleaned. Such components and systems can be removable or non-removable from the body 12 or housing 15. The term "debris" as used herein may include dirt, dust, soil, hair, and other debris, unless otherwise noted. The term "cleaning fluid" as used herein primarily encompasses liquids or other fluids and may include steam unless otherwise noted.

Figure 2:
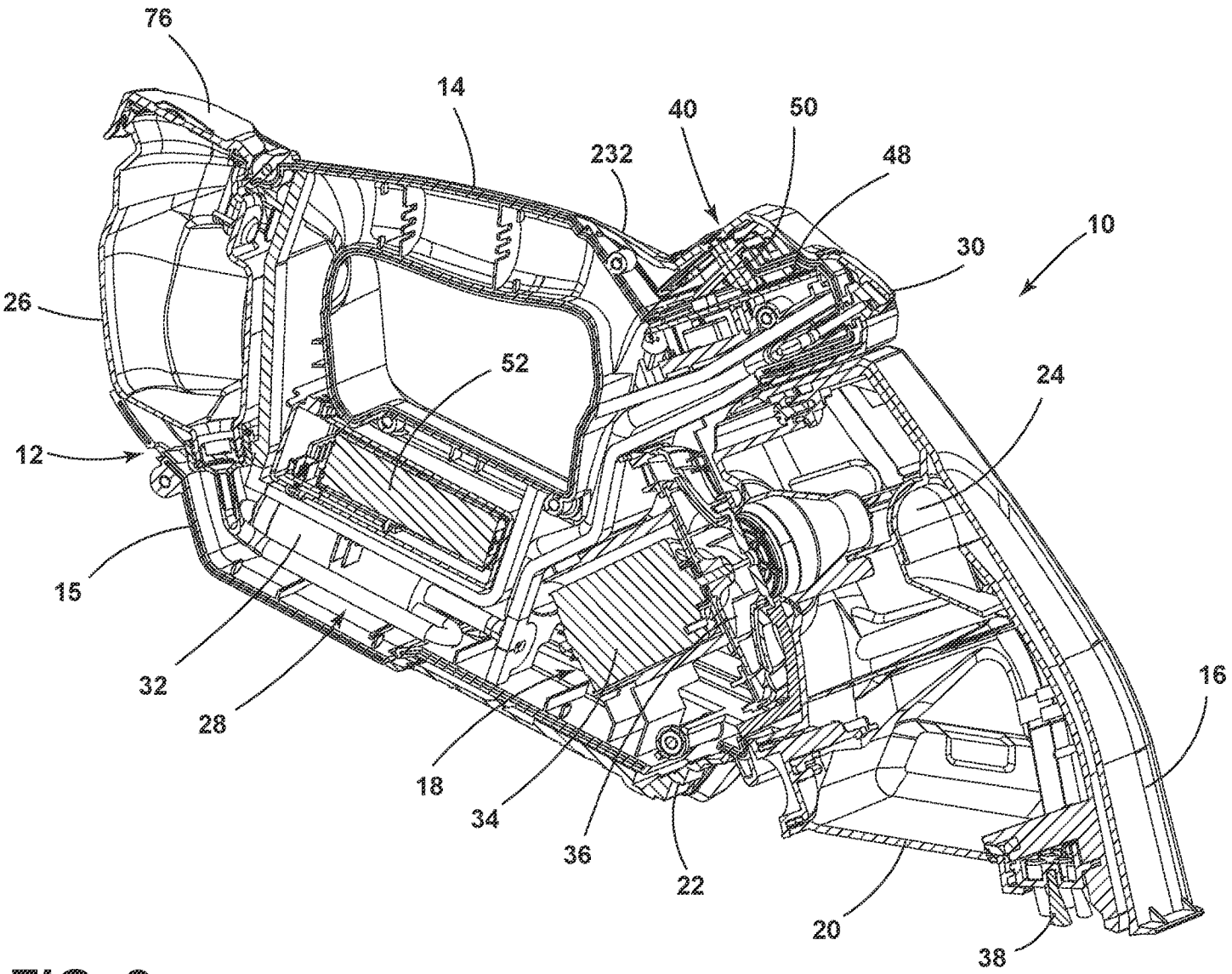
FIG. 2 is a cross-sectional perspective view of the handheld extraction cleaner, taken through line II-II of FIG. 1.

Referring additionally to FIG. 2, the recovery system can include a working air path through the body 12 and may include a dirty air inlet and a clean air outlet. The working air path can be formed by, among other elements, a suction nozzle 16 defining the dirty air inlet, a suction source 18 in fluid communication with the suction nozzle 16 for generating a working air stream, a recovery tank 20 for separating and collecting fluid and debris from the working airstream for later disposal, and exhaust vents 22 in the housing defining the clean air outlet. The recovery system can further include an initial separator 24 for separating liquid and entrained debris from the working airstream.

The initial separator 24 can be formed in a portion of the recovery tank 20, or, as illustrated herein, can be separate from the recovery tank 20. The separated fluid and debris can be collected in the recovery tank 20. In many configurations, the recovery tank 20 will be emptied prior to storage of the extraction cleaner 10.

The fluid delivery system can include a supply reservoir or supply tank 26 for storing a supply of fluid. The fluid can comprise one or more of any suitable cleaning fluids, including, but not limited to, liquid, compositions, one or more treating agents, concentrated detergent, diluted detergent, etc., or mixtures thereof. For example, the fluid can comprise a mixture of liquid and concentrated detergent.

The fluid delivery system can include a flow control system 28 for controlling the flow of fluid from the supply tank 26 to at least one fluid distributor 30. In one embodiment, described in further detail below, the flow control system 28 of the fluid delivery system can comprise a pump 32, which pressurizes the system. Optionally, a heater (not shown) can be provided for heating the cleaning fluid prior to delivering the cleaning fluid to the surface to be cleaned. In yet another example, cleaning fluid can be heated using exhaust air from a motor-cooling pathway for the suction source 18.

The suction source 18, which may be a motor/fan assembly, is provided in fluid communication with the suction nozzle 16 via the initial separator 24. As shown, the motor/fan assembly includes a suction motor or vacuum motor 34 and a suction fan or fan 36 driven by the vacuum motor 34. An inlet or fan entrance of the fan 36 is in fluid communication with air outlet of the initial separator 24.

An agitator can be provided adjacent to the suction nozzle 16 for agitating the surface to be cleaned so that the debris is more easily ingested into the suction nozzle 16. As shown, the agitator comprises a brush 38. The brush 38 can be provided at a forward portion of the unitary body 12, rearward of the suction nozzle 16. The brush 38 is stationary, i.e., fixedly mounted and non-rotating. In another configuration, the agitator for the handheld extraction cleaner 10 can comprise a powered, rotating brush or brush roll.

Referring to FIG. 1, the extraction cleaner 10 can include at least one user interface (UI) 40 through which a user can interact with the extraction cleaner 10 to operate and control the extraction cleaner 10. The UI 40 can be electrically coupled with electrical components, including, but not limited to, circuitry electrically connected to various components of the fluid delivery and collection systems of the extraction cleaner 10. The UI 40 can include one or more input controls 42, 44, which can comprise a button, trigger, toggle, key, switch, touch screen, or the like, or any combination thereof. The UI 40 can include at least one status indicator 46 that conveys information about an event or change related to the operation of the extraction cleaner 10 or its operating environment, including operational status, diagnostic information, and/or various error and fault codes.

The UI 40 can be provided on the body 12 at a forward end of the carry handle 14. The input controls 42, 44 can conveniently be provided above the handle 14, at a forward end thereof, for operation of the controls by a thumb of the user's hand that is gripping the carry handle 14. Likewise, the status indicator 46 can be provided above the handle 14, at a forward end thereof so that a user can conveniently see the status indicator 46 in a typical operational position of the extraction cleaner 10.

In the embodiment shown herein, one input control 42 is a power input control that controls the supply of power to the vacuum motor 34, another input control 44 is a dispensing input control that controls the supply of power to the pump 32 or otherwise controls dispensing of cleaning fluid via the flow control system 28. Thus, suction and fluid delivery can be implemented individually, or in combination, by operation of the input controls 42, 44. The power input control 42 can comprise a toggle switch that allows the user to change the power setting between "off" and "on" states. The fluid input control 44 can comprise a momentary switch that is only engaged while it is being depressed.

In the embodiment shown, the input controls 42, 44 can comprise buttons in register with switches on a printed circuit board (PCB) 48 (FIG. 2). The PCB 48 can include one or more LEDs that illuminate the status indicator 46, for example via at least one light pipe 50.

Electrical power can be provided by a source of main electricity or by a battery or battery pack. In the present embodiment, the extraction cleaner 10 comprises a rechargeable battery 52. The status indicator 46 can display a battery life or charge status of the battery 52. In another exemplary arrangement, the battery 52 can comprise a user replaceable battery. In yet another embodiment, the extraction cleaner 10 can comprise a power cord that is pluggable into a household outlet for corded operation.

With a rechargeable battery 52, a charging port 54 can be provided on the housing 15 and can be electrically coupled with the battery 52. In the illustrated embodiment, the charging port 54 is provided on one side of the body 12, at a forward end of the carry handle 14 and below the UI 40. A recharging cable (not shown) couples with the charging port 54 and can be plugged into a suitable electrical outlet for recharging the battery 52. In an alternative embodiment, the extraction cleaner 10 can have charging contacts on the housing 15, and a docking station (not shown) can be provided for docking the extraction cleaner 10 for recharging the battery 52.

Figure 3:
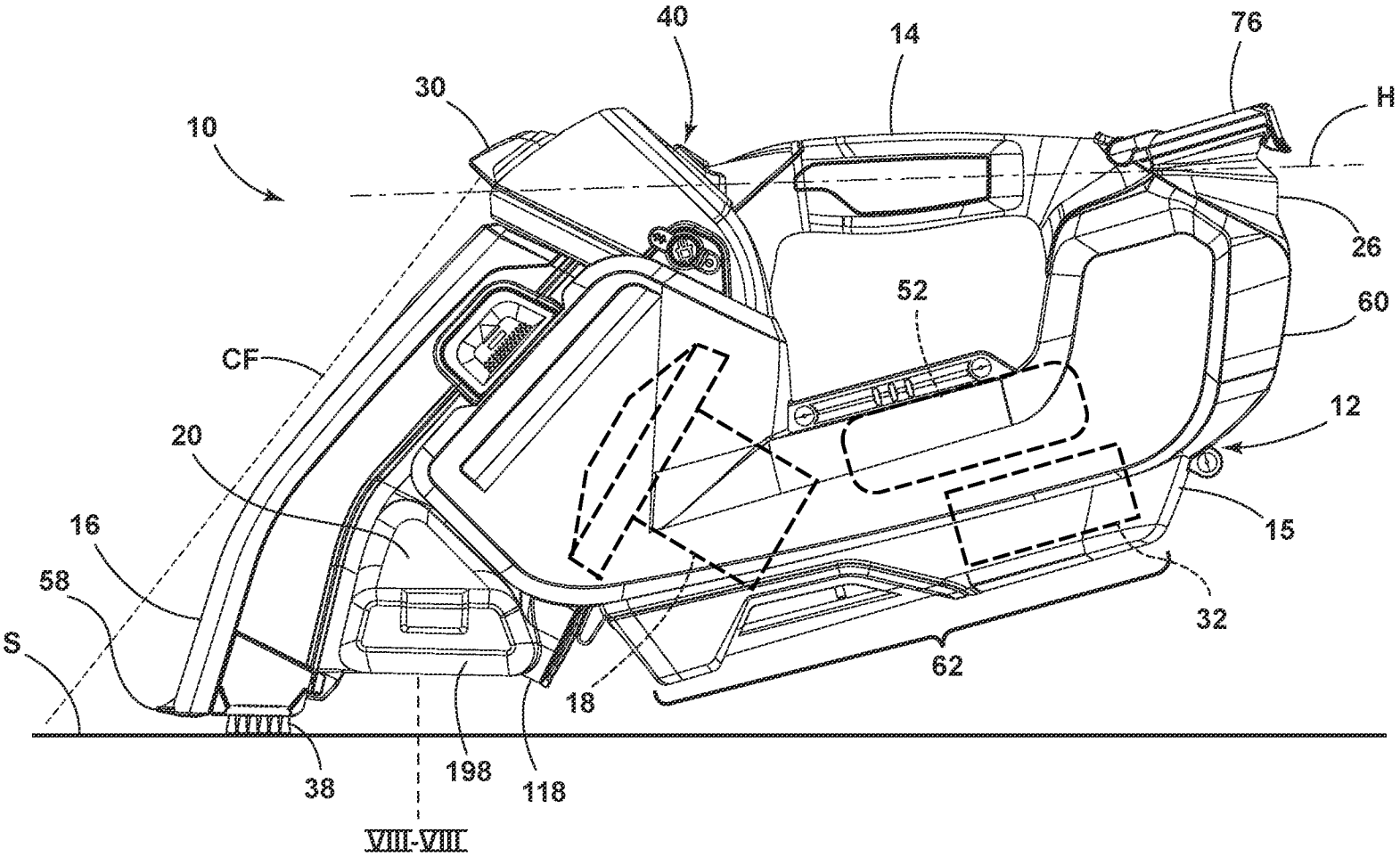
FIG. 3 is a side view of the handheld extraction cleaner in one example of a normal use position.

FIG. 3 is a side view of the handheld extraction cleaner 10 from FIGS. 1-2. The suction nozzle 16 is disposed at a forward end 58 of the body 12 while the supply tank 26, is disposed at a rearward end 60 of the body 12. The recovery tank 20 can be disposed on the housing 15 behind the suction nozzle 16 and in front of the suction source 18, shown in phantom line in FIG. 3. The battery 52, shown in phantom line in FIG. 3 can be disposed forwardly of the supply tank 26 and behind the suction source 18. The pump 32, shown in phantom line in FIG. 3, is disposed below the battery 52, and also behind the suction source 18. The carry handle 14 extends in the longitudinal direction between the UI 40 and the supply tank 26, and is disposed above the battery 52 and pump 32. The carry handle 14 includes a hand grip portion and a finger receiving area, which can be a closed volume, e.g. a closed loop handgrip. The majority of the carry handle 14 and the closed volume can be disposed behind the suction source 18. This arrangement of component parts of the extraction cleaner 10 offers a compact unit with a balanced weight-in-hand for the user, and a comfortable carrying and operational position. Other arrangements of component parts for the extraction cleaner 10 are possible.

In FIG. 3, the handheld extraction cleaner 10 is shown in one example of an operative or normal use position relative to a surface S to be cleaned. In the operative or normal use position, the extraction cleaner 10 is held with the forward end 58, particularly the suction nozzle 16 and brush 38, against the surface to be cleaned. The user may hold and manipulate the cleaner 10 via the carry handle 14. With the suction source 18, which can constitute the heaviest component of the extraction cleaner 10, disposed between the carry handle 14 and the forward end 58, more of the weight of the cleaner 10 can be supported by the surface S to cleaned, and less by the user.

The carry handle 14 may define a handle axis H along which the carry handle 14 is longitudinally extended. In the operative or normal use position, the handle axis H may be generally horizontal, or inclined from the horizontal, with "horizontal" being defined as parallel to the surface to be cleaned S. Having a substantially horizontal handle axis H positions the user's hand and wrist in an ergonomic position with more grip strength for holding the extraction cleaner 10 at an optimal cleaning angle.

The handheld extraction cleaner 10 can rest in a stable manner on the surface S in a horizontal position, without leakage from either tank 20, 26. In a self-standing or at rest position, the extraction cleaner 10 can be supported on a substantially flat resting surface 62 on a bottom of the body 12. With the resting surface 62 lying on the surface to be cleaned S, the forward end 58 is supported away from the surface S. A user can therefore set the extraction cleaner 10 down in a stable position, upon a shelf or a countertop, for example, without having the suction nozzle 16 or brush 38 in contact with the surface S, and any residual fluid or dirt on the brush 38 will not transfer to the surface S. Heavy components (relative to the weight of other components of the cleaner 10) such as the pump 32 and battery 52 can be disposed above the resting surface 62, which increases stability in the horizontal position.

It is noted that, while the extraction cleaner 10 is shown and described in FIG. 3 in relation to a horizontal surface S to be cleaned, the extraction cleaner 10 may also be used to clean angled surfaces, such as stairs, upholstered furniture, car seats, and the like. Therefore, it is understood that various use orientations are possible.

Figure 4:
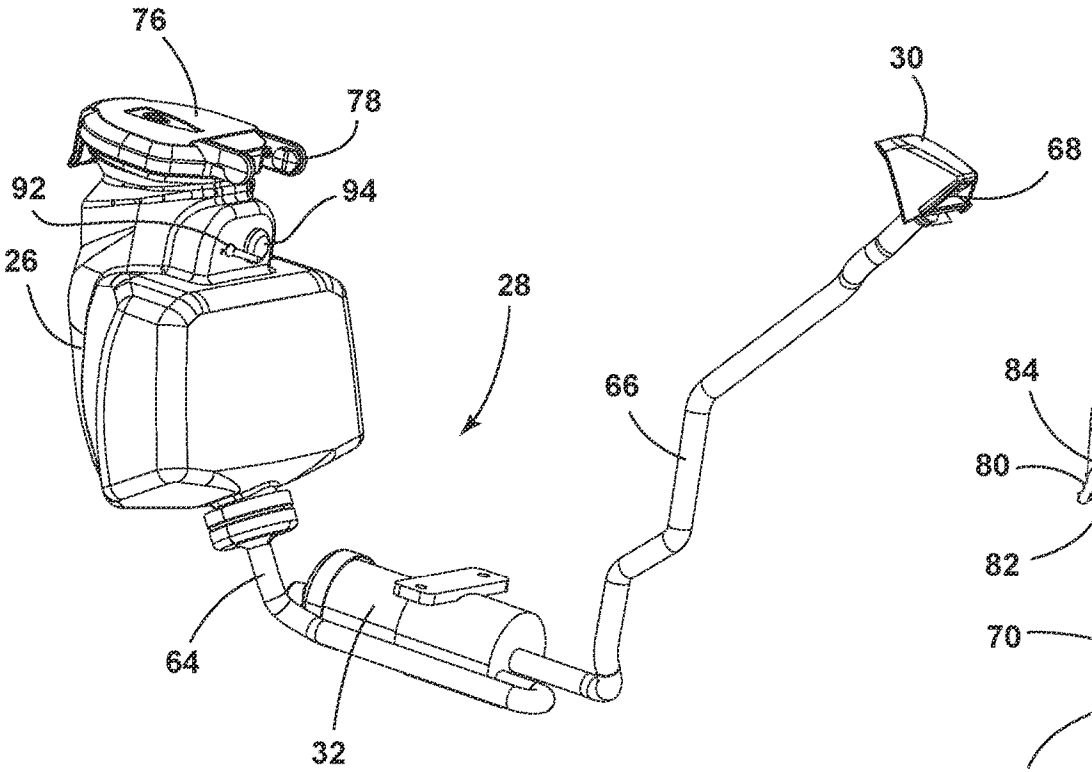
FIG. 4 is a view showing a fluid delivery system of the handheld extraction cleaner, with components of the fluid delivery system shown in isolation, the fluid delivery system including a supply tank.

FIG. 4 is a schematic view of the fluid delivery system of the handheld extraction cleaner 10, shown in isolation from the other components of the cleaner 10. As discussed above, the fluid delivery system illustrated herein includes the supply tank 26, the pump 32, the fluid distributor 30, and optionally additional conduits, ducts, tubing, hoses, connectors, etc. fluidly coupling the components of the fluid delivery system together and providing a supply path from the supply tank 26 to the fluid distributor 30. For example, a first conduit 64 can connect an outlet of the supply tank 26 with an inlet of the pump 32 and a second conduit 66 can connect an outlet of the pump 32 with an inlet of the fluid distributor 30. The conduits 64, 66 can comprise flexible tubing as shown in FIG. 4, but it is understood that any of the conduits can comprise molded rigid conduits, or a combination of conduits, ducts, tubing, hoses, connectors, etc.

In one example, the pump 32 can be a centrifugal pump. In another example, the pump 32 can be a diaphragm or membrane pump. In still another example, the pump 32 can be a manually actuated spray pump. In yet another configuration of the fluid delivery system, the pump 32 can be eliminated and the flow control system 28 can comprise a gravity-feed system having a valve fluidly coupled with an outlet of the supply tank 26, whereby when valve is open, fluid will flow under the force of gravity to the distributor 30. However, the use of a pump offers the advantage of orienting the supply tank 26 and fluid distributor 30 relative to other components on the body 12 to provide a more balanced weight in hand as well as providing more consistent fluid flow rate compared to a gravity fed system.

The fluid distributor 30 can include at least one distributor outlet 68 for delivering fluid to the surface to be cleaned. The outlet 68 can be positioned to deliver fluid directly to the surface to be cleaned, outwardly in front of the suction nozzle 16 so that the user can clearly see where fluid is being applied. See, for example, line CF in FIG. 3 representing one possible spray path for the distributor 30. In another embodiment, the outlet 68 can deliver fluid onto the brush 38. In yet another embodiment, the outlet 68 can deliver fluid behind the suction nozzle 16 and brush 38.

The distributor 30 can comprise any structure, such as a nozzle or spray tip. Multiple distributors 30 can also be provided in other embodiments of the extraction cleaner 10. As illustrated in the figures, the distributor 30 can comprise one spray tip provided on the front of the body 12 that distributes cleaning fluid to the surface to be cleaned in front of the suction nozzle 16.

Figure 5:
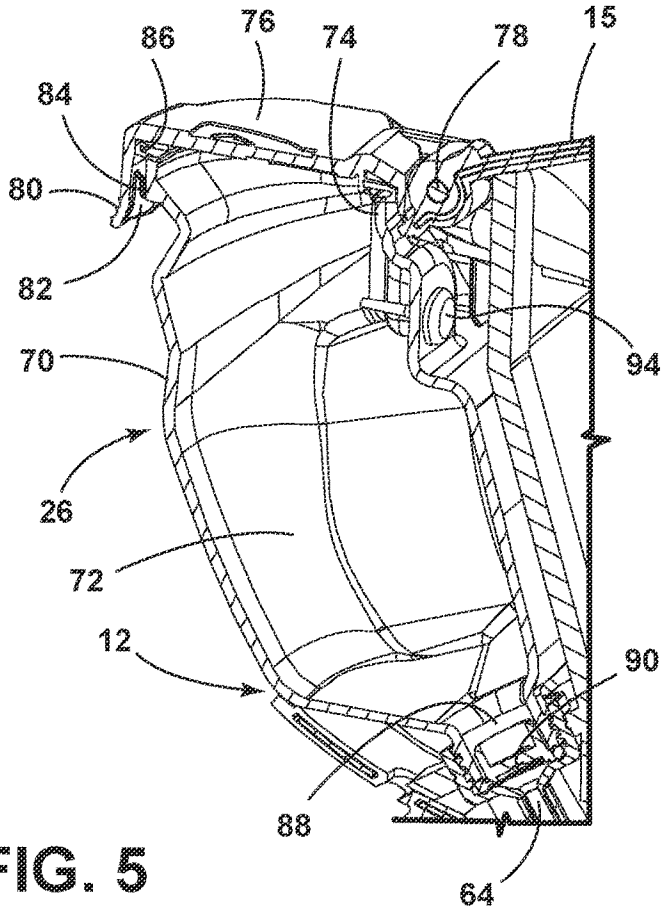
FIG. 5 is a close-up sectional view of a rear portion of the handheld extraction cleaner, taken through line II-II of FIG. 1, showing the supply tank.

FIG. 5 is a close-up sectional view showing the supply tank 26. The supply tank 26 shown is a non-removable blow-molded part, and includes a hollow tank body 70 defining a supply chamber 72 for holding a supply of cleaning liquid. In being non-removable, the supply tank 26 is not intended to be removed from the body 12, and is refillable in place on the body 12. This can eliminate potential leakage points, since the supply tank 26 does not need to be repeatedly coupled and uncoupled to the fluid pathway of the extraction cleaner 10.

The tank body 70 can include a fill opening 74 through which cleaning liquid can be poured into the supply chamber 72. The fill opening 74 can be provided at the rearward end of the body 12, rearward of the handle 14, and is accessible to a user when the housing 15 is resting on a surface. A fill cap 76 selectively closes the fill opening 74.

The fill cap 76 can be pivotally coupled to the housing 15 of the cleaner body 12 by a hinge 78 or other rotating connection and can be opened to expose the fill opening 74. The pivotable coupling ensures the fill cap 76 will not completely separate from the cleaner body 12 during filling. In another aspect, the fill cap 76 can be pivotally coupled with the tank body 70.

The fill cap 76 can fit over the fill opening 74 when closed to seal the fill opening 74 for a fluid-tight closure, such that the supply tank 26 does not leak when the fill cap 76 is closed. One example of a closed position of the fill cap 76 is shown in FIG. 5.

In one configuration, the fill cap 76 can be a snap-on cap providing a fluid-tight engagement with the fill opening 74 when snapped onto the tank body 70. The cap 76 can include a depending lip 80 with a snap 82 that extends from an inward side of the lip 80, and the tank body 70 can include an outwardly extending bead 84, with the snap 82 fitting tightly onto the bead 84 when the cap 76 is closed. A seal 86 can be provided on an inner side of the cap 76 that confronts the fill opening 74 when the cap 76 is closed to further provide a leak-proof engagement between the fill opening 74 and the fill cap 76.

The fill cap 76 can be opened by lifting the lip 80 of the fill cap 76, which can be spaced from the tank body 70 in the closed position so that a user can fit a finger between the tank body 70 and an underside of the lip 80. When the fill cap 76 is open, liquid from a liquid source, such as a container, bottle, faucet, hose, vessel, etc. can be poured into the tank body 70 through the fill opening 74.

The tank body 70 can include a tank outlet 88 in fluid communication with the first conduit 64. A mesh screen insert 90 may be provided between the tank outlet 88 and the conduit 64 to prevent or inhibit particulates of a certain size from entering the pump 32.

A first check valve 92 (FIG. 4) is provided on the tank body 70 to allow ambient air into the supply tank 26 to displace dispensed liquid. The check valve 92 can be, for example, an umbrella valve sealing at least one vent hole formed in the tank body 70. As liquid is pumped out of the supply tank 26, negative pressure inside the supply tank 26 opens the check valve 92, drawing ambient air into the supply chamber 72 to equalize pressure. Once pressure equalizes, the check valve 92 closes.

A second check valve 94 is provided on the tank body 70 for relieving positive pressure or off-gassing caused by some cleaning liquids. With some formulations of cleaning liquids, excess gas is generated inside the supply tank 26 due to reactions between various additives or off-gassing from peroxide formulations, for example. The check valve 94 can be, for example, an umbrella valve selectively sealing at least one vent hole in the tank body 70. As excess gas forms in the supply tank 26, positive pressure inside the supply tank 26 opens the check valve 94, thereby venting the excess gas into the surrounding atmosphere. Once pressure equalizes, the check valve 94 closes.

Figure 6:
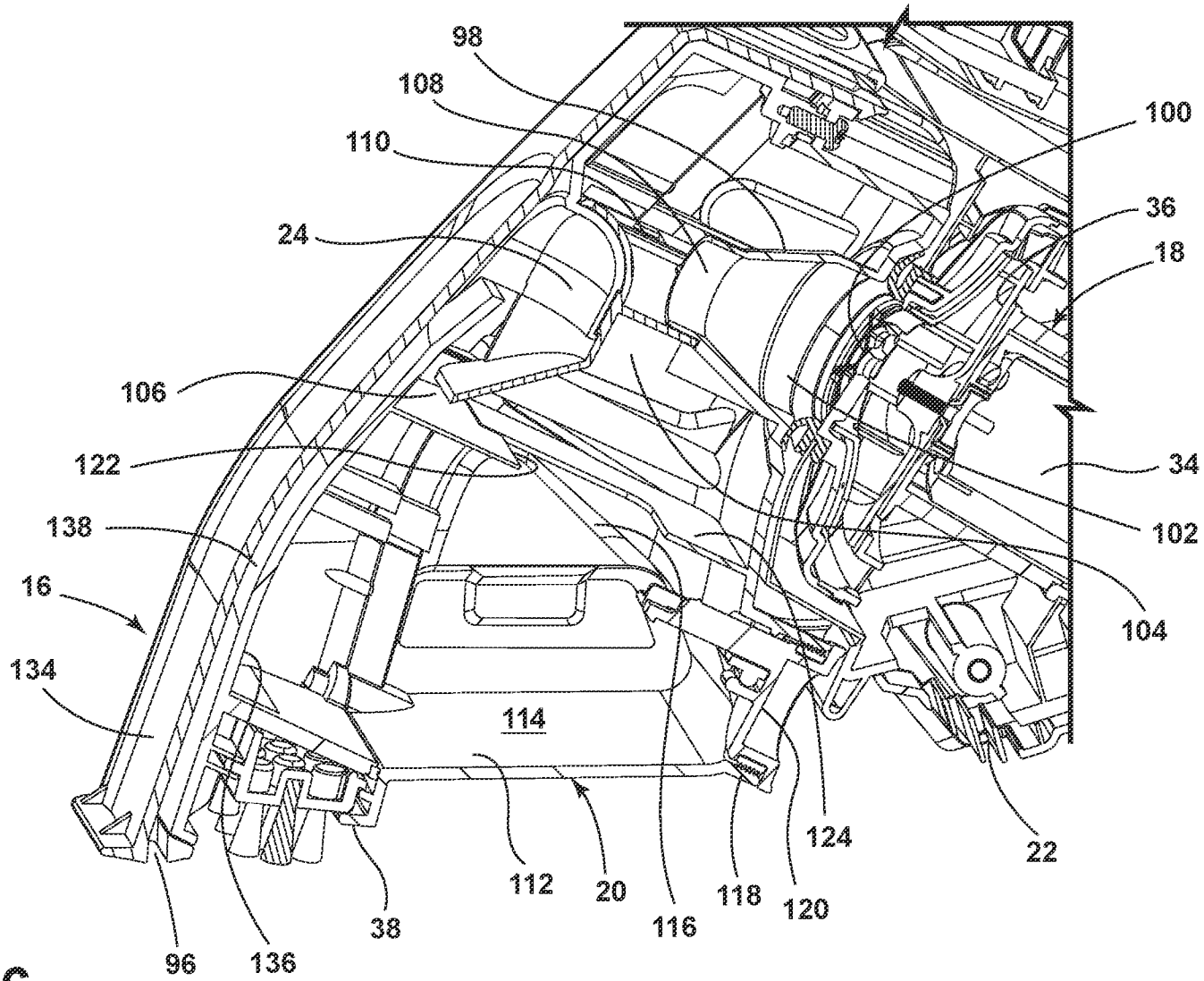
FIG. 6 is a cross-sectional view showing a recovery system of the handheld extraction cleaner, taken through line VI-VI of FIG. 1, the recovery system including a recovery tank.

FIG. 6 is a sectional view showing the recovery system of the handheld extraction cleaner 10. As discussed above, the recovery system illustrated herein includes the suction nozzle 16, the initial separator 24, the recovery tank 20, the suction source 18, the exhaust vents 22 (FIG. 2), and optionally additional conduits, ducts, tubing, hoses, connectors, etc. fluidly coupling the components of the recovery system together and providing a recovery path from a nozzle inlet 96 to the exhaust vents 22.

In one configuration, working air separated from liquid and debris by the initial separator 24 can travel through a diffuser conduit 98 before reaching an inlet 100 of the suction source 18. Either the diffuser conduit 98 or the inlet 100 may be referred to as a fan entrance. The diffuser conduit 98 has a gradually increasing cross-sectional area to decrease the speed of the working air and increase its pressure. The diffuser conduit 98 may have an outlet port 102 in fluid communication with the inlet 100 of suction source 18.

An air pathway 104 can connect a separator outlet 106 of the initial separator 24 with a conduit inlet 108, which may also be referred to as the fan entrance, of the diffuser conduit 98 and can be formed by various conduits, ducts, housings, connectors, etc., fluidly coupling the separator outlet 106 and conduit inlet 108 together and providing an air path from the initial separator 24 to the diffuser conduit 98. To improve air/liquid separation and sound attenuation, the pathway 104 may be a tortuous air pathway 104, and may include baffles, guides, and other air-turning features that direct the working air and increase the length of the pathway 104. In one example, the air pathway 104 can include a baffle 110 blocking a lower portion of the conduit inlet 108 so that working air is forced to flow around, and over, the baffle 110 to enter the conduit inlet 108.

The recovery tank 20 comprises a hollow tank body 112 defining a collection chamber 114 for holding a recovered liquid and debris, with a tank inlet 116 that is in fluid communication with the separator outlet 106 and a tank outlet 118 formed in the tank body 112 for emptying any liquid or debris in the recovery tank 20 that may be collected in the collection chamber 114. The tank outlet 118 can be closed by a drain plug 120 or other closure feature.

The tank inlet 116 to the recovery tank 20 can be formed as a tank opening 122, which may also be referred to as the tank inlet, through a baffle wall 124 separating the collection chamber 114 from the tortuous air pathway 104, with debris and liquid that is separated from the working airstream transferrable into the recovery tank 20 through the tank opening 122. Other configurations for the tank inlet 116 are possible.

The baffle wall 124 can surround the tank opening 122 on multiple sides to block liquid from passing back through the tank inlet 116 when the extraction cleaner 10 is tipped sideways. In one configuration, the baffle wall 124 can surround the tank opening 122 on right and left sides, so that if the extraction cleaner 10 is tipped to the side, the baffle wall 124 keeps liquid out of the air pathway 104. Optionally, in some configurations, the baffle wall 124 can also surround the tank opening 122 on forward and/or rearward sides. A portion of the baffle wall 124 may extend under the separator outlet 106, and may be disposed at a downward angle when the extraction cleaner 10 is in the orientation of FIG. 3 to allow liquid to flow toward the tank inlet 116.

Referring to FIG. 6, the suction nozzle 16 can include a front nozzle cover 134 and a rear cover 136 defining a narrow suction pathway 138 therebetween, with an opening forming the nozzle inlet 96 at a lower end thereof. The suction pathway 138 is in fluid communication with the initial separator 24 leading to the recovery tank 20. The front nozzle cover 134 can optionally include a transparent or translucent window, or can be formed by a transparent or translucent material, so the user can see liquid being taken up through the suction nozzle 16 and/or determine if the suction nozzle 16 is clogged.

Figure 7:
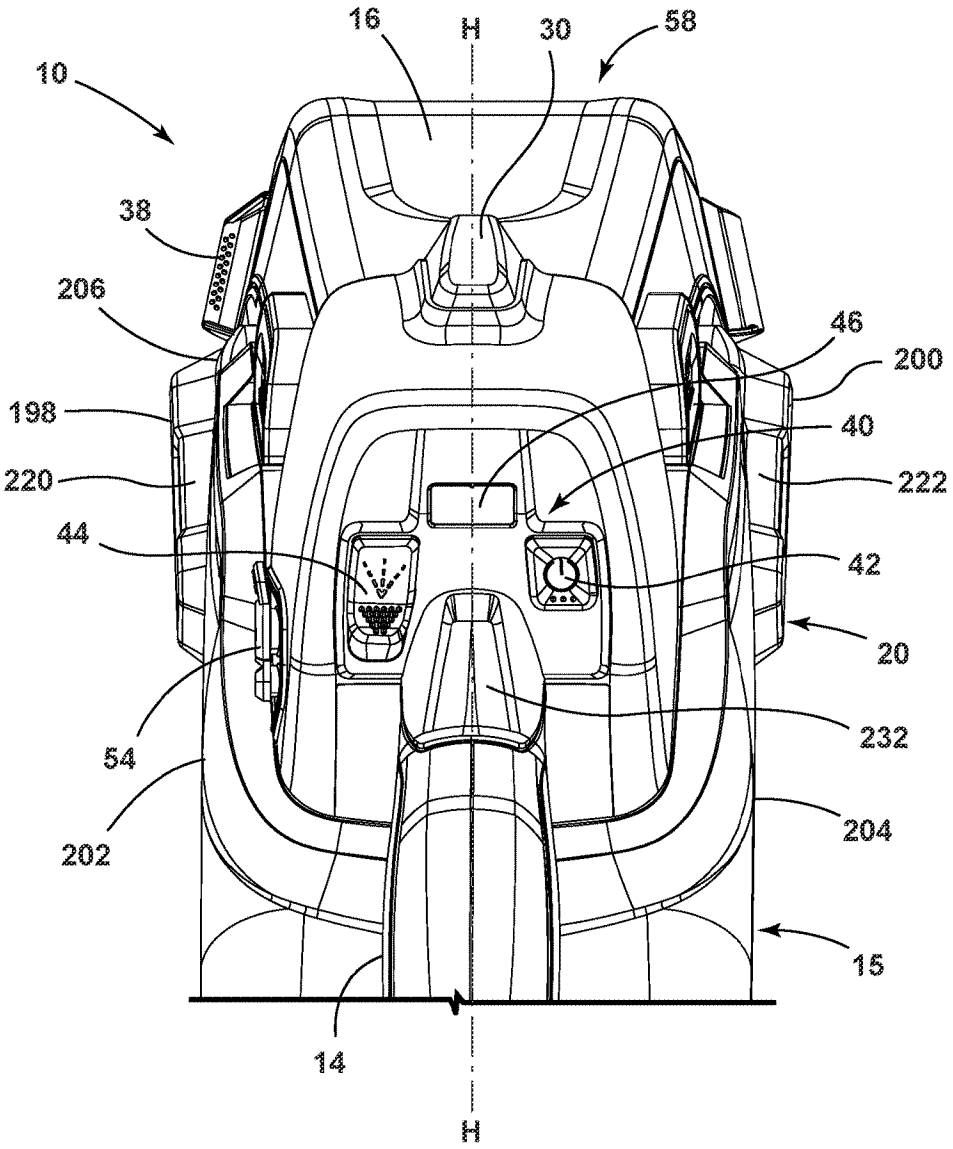
FIG. 7 is a top perspective view of the handheld extraction cleaner, generally from the perspective of a user holding the handheld extraction cleaner in an operative or normal use position, such as illustrated in FIG. 3, for example.

Referring to FIG. 7, an example of a user's perspective of the extraction cleaner 10 during operation is shown. Generally, during operation a user will grasp the extraction cleaner 10 by the carry handle 14 and engage the forward end 58 with the surface to be cleaned. The recovery tank 20 can be configured such that, in this use position, the user can view the fullness or fill level of the recovery tank 20. The recovery tank 20 can further be configured to be equally viewable by a right-handed user and a left-handed user.

In one configuration, the recovery tank 20 has a tank body 112 with side portions 198, 200 that extend outwardly with respect to the housing 15 so as to be visible from the user's perspective during operation. The housing 15 has a first lateral side 202 and a second lateral side 204, which can comprise left and right lateral sides, respectively, (as viewed from the use position shown in FIG. 7) and the tank body 112 can have a first side portion 198 which is disposed laterally outwardly with respect to the first lateral side 202 of the housing 15 and a second side portion 200 which is disposed laterally outwardly with respect to the second lateral side 204 of the housing 15.

The flared side portions 198, 200 can be disposed substantially in front of the carry handle 14. The recovery tank 20, and flared side portions 198, 200, are thus located closer to the forward end 58 of the extraction cleaner 10 than the rearward end 60 (FIG. 3) so that a user has a clear view of the tank 20 and its fill level.

The side portions 198, 200 of the tank body 112 can flare outwardly from a longitudinal centerline of the extraction cleaner 10, which in some configurations of the extraction cleaner 10 may be defined by the handle axis H. In the embodiment shown, the side portions 198, 200 are mirror images of each other and can be equal in volume, although it is understood that differences in shape, volume, etc., of the side portions 198, 200 is possible.

With flared side portions 198, 200 on both lateral sides 202, 204 of the housing 15, the recovery tank 20 is equally viewable by a right-handed user and a left-handed user, and a user can observe the recovery tank 20 even if the extraction cleaner 10 is tipped sideways. The flared shape of the recovery tank 20 can also increase the collection capacity of the tank body 112. The flared side portions 198, 200 allow the volume of collected liquid to spread out laterally, which can reduce the height of collected liquid.

Figure 8:
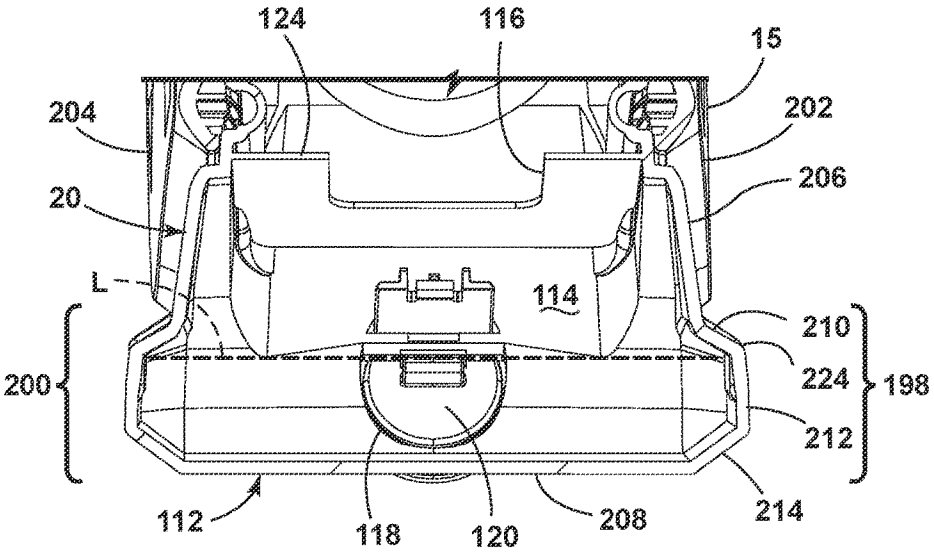
FIG. 8 is a plane intersection view taken through line VIII-VIII of FIG. 3, showing an exemplary liquid level in the recovery tank when the extraction cleaner is operating on a horizontal surface.
Figure 9:
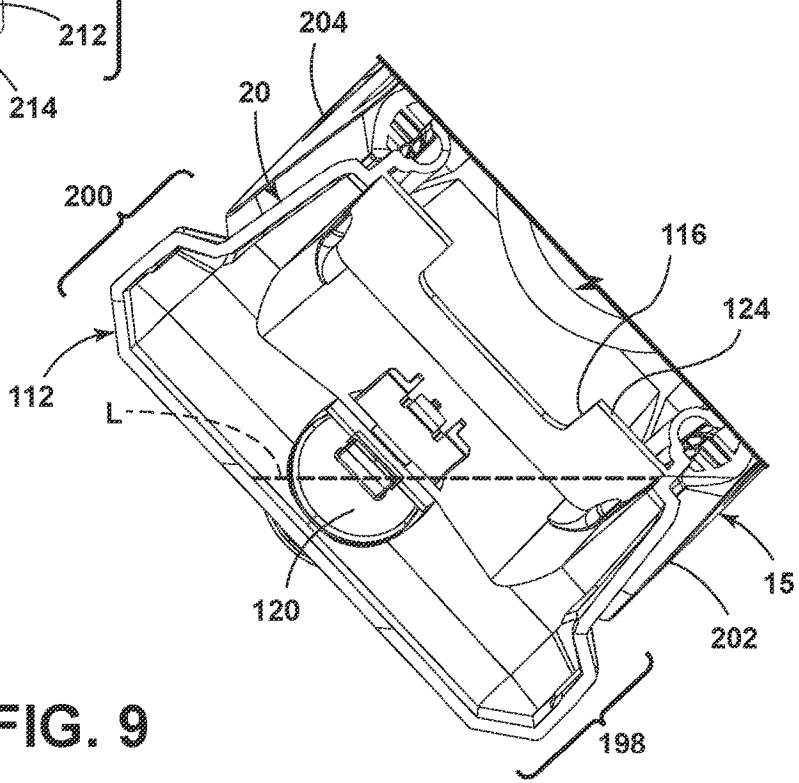
FIG. 9 is a view similar to FIG. 8 showing the liquid level in the recovery tank when the extraction cleaner is tipped to one side.

Another benefit to having flared side portions 198, 200 on both sides of the recovery tank 20 is an increase in volume available on each side of the tank 20 when the extraction cleaner 10 is tipped sideways. FIGS. 8-9 are cross-sectional views taken through line VIII-VIII of FIG. 3 showing a liquid level indicated by phantom line L for a given volume of liquid in the tank 20 when the extraction cleaner 10 is in two different exemplary orientations. FIG. 8 shows the liquid level L when the extraction cleaner 10 is in the orientation of FIG. 3 and operating on a horizontal surface S to be cleaned. FIG. 9 shows the liquid level L for the same volume of liquid when the extraction cleaner 10 is tipped to the left. In the tipped position, a greater portion of the liquid moves into the space defined by the first side portion 198. When the extraction cleaner 10 is tipped to the right, a greater portion of the liquid can move into the space defined by the second side portion 200. When tipped, as shown in FIG. 9, the liquid level L does not rise up to the height of the tank inlet 116, but rather spreads into the corresponding side portion 198, 200. Therefore, there is less likelihood of ingestion of liquid into the air pathway 104.

To help inhibit or prevent the liquid from reaching the air pathway 104, the baffle wall 124 in the tank 20 can block the liquid when the extraction cleaner 10 is tipped sideways. Below a certain level of liquid and at certain degrees of tip, liquid in the tank 20 cannot reach the tank inlet 116. With the provision of the flared side portions 198, 200 and/or the baffle wall 124, the recovery tank 20 does not require an in-tank float-style shut off. In other words, the recovery tank 20 shown in the figures is a float-less tank.

Various shapes for the flared side portions 198, 200 are possible. Referring to FIGS. 8-9, one embodiment of the first side portion 198 is disclosed. It is understood that the second side portion 200 may have the same or a similar configuration.

The tank body 112 can have a tank side wall 206 and the first side portion 198 can extend outwardly from the tank side wall 206. The tank side wall 206 can be flush with or recessed to the first lateral side 202 of the housing 15, such that the tank side wall 206 is disposed substantially in line with or laterally inwardly of the first lateral side 202. At a bottom end thereof, the flared side portion 198 can turn back in toward the housing 15 and may meet a bottom wall 208 of the tank body 112.

Figure 10:
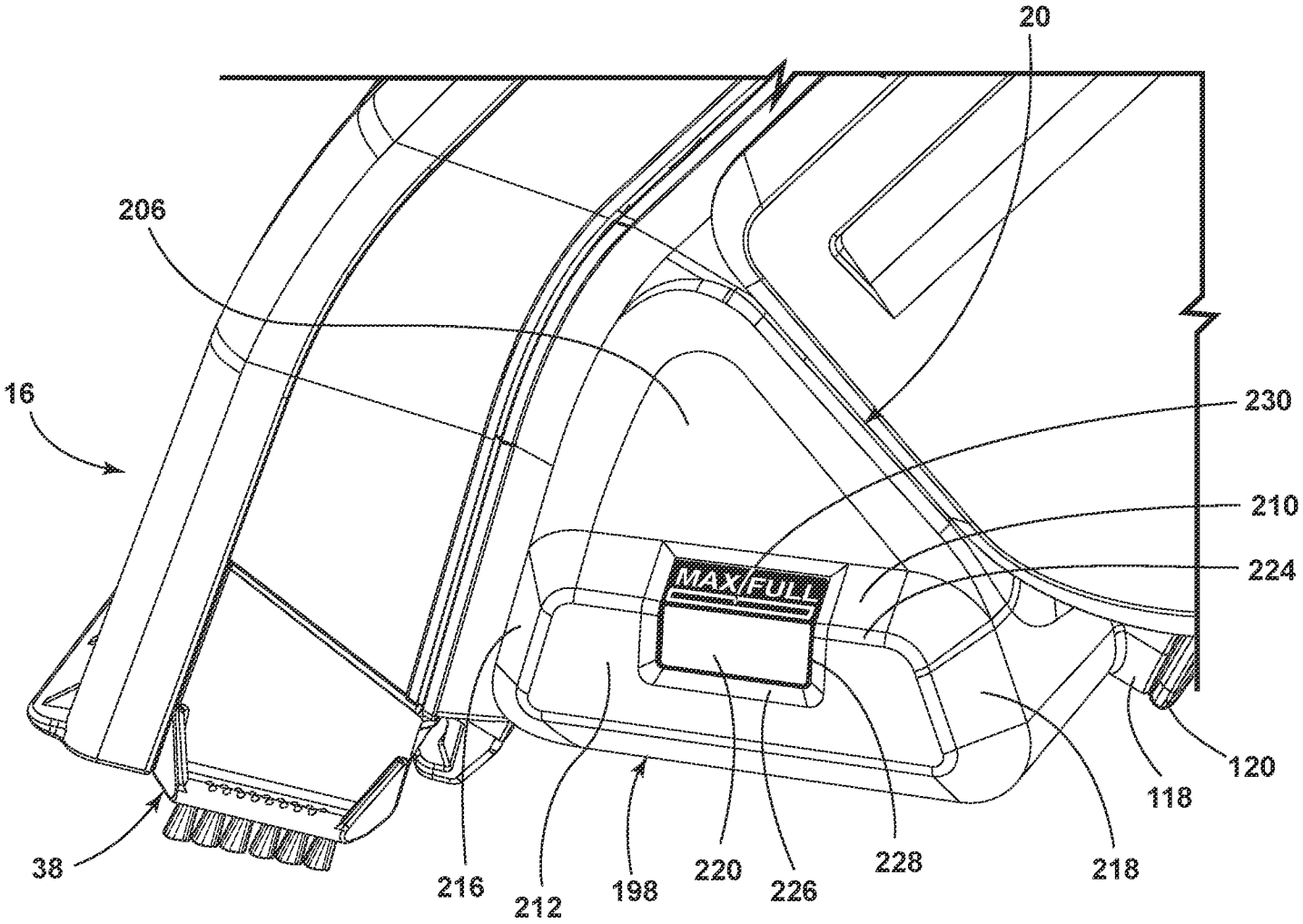
FIG. 10 is a side perspective view of the handheld extraction cleaner, showing a flared side portion and viewing window of the recovery tank.

Referring to FIG. 8, the first side portion 198 can include at least an upper wall 210, an outer wall 212, and a lower wall 214. One or more of these walls can be angled so that the first side portion 198 has a contour that can encourage liquid to move toward the tank outlet 118, which is closed by the drain plug 120 in FIG. 8. For example, the upper and lower walls 210, 214 can taper toward the outer wall 212 so that the first side portion 198 has a double beveled contour when viewed from the front or from the rear. With a contour that tapers downwardly and toward the center of the tank 20, liquid is encouraged to move downwardly along the walls 210-214 and toward the tank outlet 118. Referring to FIG. 10, the first side portion 198 can include a front wall 216 at a forward end of the outer wall 212 and a rear wall 218 at a rearward end of the outer wall 212. These walls 216, 218 can also be angled to encourage liquid to move downwardly along the walls 216, 218.

The bottom wall 208 can also have a shape which improves cleaning liquid drainage and usable tank volume, such as by sloping rearwardly toward the tank outlet 118 when the extraction cleaner 10 is at rest on the resting surface 62, as shown in FIG. 3, which directs dirty liquid away from the tank inlet 116 and toward the tank outlet 118. Similarly, when the recovery assembly—formed from portions of the recovery tank 20 and the suction nozzle 16 as a unit—is removed and rested on a surface, the recovery assembly is supportable on a bottom edge of the drain plug 120 and the brush 38, and the bottom wall 208 is oriented to slope rearwardly toward the tank outlet 118.

A level viewing window 220, 222 can be located on one or both side portions 198, 200 of the recovery tank 20 with the viewing windows 220, 222 providing information to the user on the fill level within the recovery tank. With viewing windows 220, 222 on both lateral sides 202, 204 of the housing 15, a user can be informed of the fill level regardless of whether the extraction cleaner 10 is held in their right or left hand, and even if the extraction cleaner 10 is tipped sideways.

The viewing windows 220, 222 can be a transparent or translucent portion of the recovery tank 20 through which the fill level in the recovery tank 20 can be visually determined. In one embodiment, the recovery tank 20 can be a blow-molded part made from a transparent or translucent material, with the viewing windows 220, 222 comprising molded features in the tank body 112. In another embodiment, the viewing windows 220, 222 can be formed by inserting a transparent or translucent cover into a corresponding window opening in the tank body 112.

In the exemplary embodiment of FIG. 10, viewing window 220 is located on two walls 210, 212 of the tank body 112, and wraps around a corner 224 between the two walls 210, 212. Locating the viewing window 220 on the upper wall 210 and outer side wall 212 of the side portion 198 places the viewing window 220 in the user's line of sight, with a user being able to see the viewing window 220 from a centered perspective shown in FIG. 7 or when the extraction cleaner 10 is tilted sideways for cleaning an angled surface. FIG. 10 shows an example of a user's perspective of the extraction cleaner 10 during operation, where the user has tilted the extraction cleaner 10 sideways.

The viewing window 220 may be recessed into the walls 210, 212. In an embodiment where the viewing window 220 is a molded feature in the tank body 112, a beveled edge 226 can serve as a transition between the walls 210, 212 and the recessed window 220.

Optionally, the tank body 112 may have indicia markings associated with the viewing window 220. One exemplary embodiment of such indicia markings is shown in FIG. 10, where the viewing window 220 has a border marking 228, which may be in a contrasting color to the tank body 112 that draws a user's attention to the viewing window 220. Observing a fill level within the border marking 228 can signal to the user that a fill quantity in the recovery tank 20 is approaching a maximum level and/or is within a recommended range for emptying the tank 20. The viewing window 220 can also have a maximum fill line 230 that indicates a recommended maximum fill quantity in the recovery tank 20. The border marking 228 can wrap around the corner 224 and the maximum fill line 230 extend along the corner 224, and preferably above the corner 224. It is understood that the second viewing window 222 may have the same or similar indicia markings.

Referring to FIG. 7, in addition to the recovery tank 20, the suction nozzle 16, distributor 30, user interface 40, brush 38, or any combination thereof, may be in the line of sight of the user during normal operation of the extraction cleaner 10. In the exemplary embodiment, the user interface 40 is not symmetrical about the handle axis H, but is convenient for use by a right-handed or left-handed user.

Gripping the carry handle 14 in one hand, whether left or right, allows both input controls 42, 44 to be actuated by the thumb of that same hand. The end of the carry handle 14 toward the user interface 40 can have a recessed thumb rest 232 for the user's thumb, so that the thumb of the hand gripping the carry handle 14 has a home space or resting space, and does not accidentally bump the input controls 42, 44. The input controls 42, 44 can be different in size, shape, color, tactile elements, and the like, so that a user can distinguish between them by sight or by feel.

Figure 11:
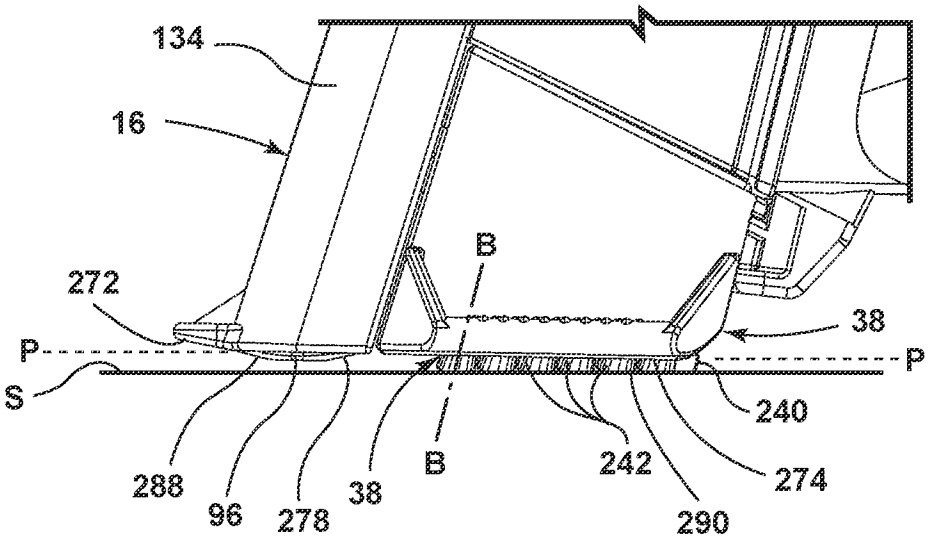
FIG. 11 is a close-up, side view of the handheld extraction cleaner in one example of a normal use position.

FIG. 11 shows the extraction cleaner 10 in one non-limiting example of a generally optimal cleaning position in which the nozzle inlet 96 is substantially flat against the surface S. The optimal cleaning position for efficient extraction may vary depending on the relative disposition of the components of the cleaner 10, such as, but not limited to, the body 12, carry handle 14, suction nozzle 16, and nozzle inlet 96. A user may not understand the angle for optimal extraction, and may not intuitively tip the extraction cleaner 10 far enough forward.

A cleaning angle guide skid 270 (better viewed in FIG. 12) provides a structural element that encourages the user to naturally orient the cleaner 10 at an optimal angle for efficient extraction. As an added benefit, the cleaning angle guide skid 270 can help the extraction cleaner 10 glide over the surface S, which helps the user move the extraction cleaner 10 smoothly over the surface.

The guide skid 270 can include one or more skis, lips, runners, gliding surfaces, skids, or the like surrounding the nozzle inlet 96 and/or the brush 38, and which may at least partially support the forward end 58 of the extraction cleaner 10 on the surface S to be cleaned. In one embodiment, the guide skid 270 can include at least a front ski 272 and side skis 274, 276 behind the front ski 272. The skis 272-276 can have substantially flat contact surfaces, or may be slightly tapered or curved, to help the suction nozzle 16 glide over the surface for easy movement of the cleaner 10 in a back and forth direction across the surface to be cleaned. Thus, the skis 272-276 of the guide skid 270 allow the suction nozzle 16 to glide over the surface S in a similar manner as a ski so that a user can pass or glide the extraction cleaner smoothly over a surface. While various configurations for the skis 272-276 are possible, the skis 272-276 can preferably have smoothly curved or angled surfaces, edges, corners, and the like, to reduce sliding friction.

With multiple skis 272-276 projecting in multiple directions around the periphery of the suction nozzle inlet 96, the user is guided to position the cleaner 10 at an optimal angle for efficient extraction, particularly one in which the suction nozzle inlet 96 is flat or nearly flat against the surface to be cleaned. The front ski 272 can comprise an elongated, slender runner that extends substantially the width of the nozzle inlet 96 across the front of the suction nozzle 16. In the embodiment shown, the front ski 272 can project from a forward edge of the front nozzle cover 134. Where the nozzle cover 134 and front ski 272 are plastic, the front ski 272 can be integrally formed with the nozzle cover 134.

In certain embodiments, the guide skid 270 can further include intermediate skis 278 that extend alongside the lateral ends of the nozzle inlet 96 and which can substantially bridge a gap between the front ski 272 and side skis 274, 276. In the embodiment shown, the intermediate skis 278 can be defined by bottom surfaces of the front nozzle cover 134. Where the nozzle cover 134 and intermediate skis 278 are plastic, the intermediate skis 278 can be integrally formed with the nozzle cover 134.

It is noted that nozzle inlet 96 can be single opening extending substantially the width of the suction nozzle 16, or a plurality of smaller openings separated by dividers, such that the dividers serve to reinforce the suction nozzle 16. The dividers can be flush with or recessed with respect to the guide skid 270.

An inclined peripheral wall 288 can extend around the nozzle inlet 96, the inclined peripheral wall 288 extending from the guide skid 270 downwardly and inwardly toward the openings. The peripheral wall 288 surrounding the nozzle inlet 96 may therefore project slightly with respect to the guide skid 270. In other embodiments, the peripheral wall 288 surrounding the nozzle inlet 96 may not project relative to the guide skid 270 and may, for example and without limitation, be flush with the guide skid 270.

Figure 12:
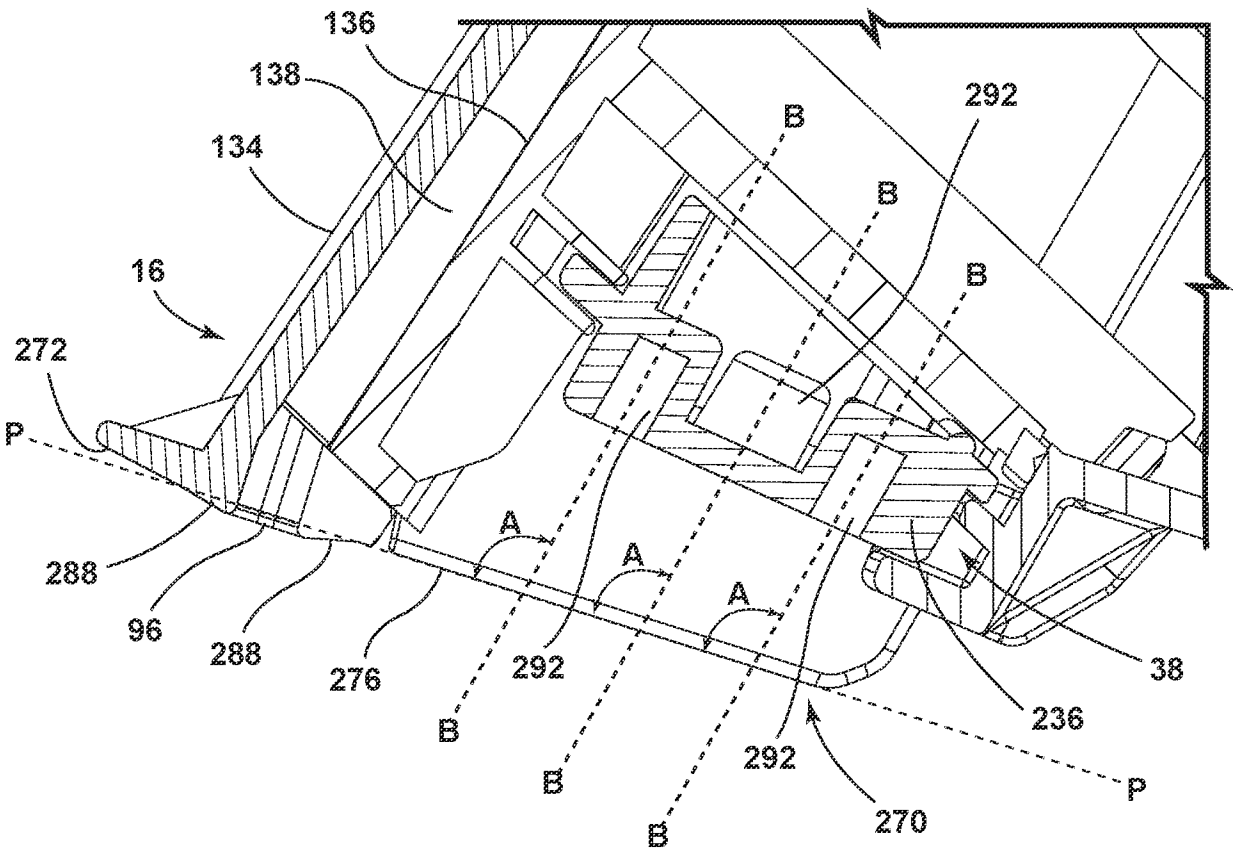
FIG. 12 is a cross-sectional view taken through line XII-XII of FIG. 1, showing an orientation of the guide skid relative to an agitator.

Referring to FIGS. 11-12, the side skis 274, 276 may generally lie within a common plane P, thereby being flush with each other. At least a portion of the front ski 272 may lie in the same plane P. In the embodiment shown, the intermediate skis 278 can lie within the plane P, and the front ski 272 may turn upwardly away from the plane P. The peripheral wall 288 surrounding the nozzle inlet 96 extend below the plane P.

An agitation element 240, such as bristles 242, may extend below the guide skid 270, such as with tips 290 of the bristles 242 in particular extending below the side skis 274, 276, e.g., below the plane P. With the guide skid 270 pressed against the surface S, such that the cleaner 10 is properly oriented, the agitation element 240 can dig into the surface S, providing enhanced scrubbing action.

In certain embodiments, the agitation element 240 is angled with respect to the guide skid 270 to resist movement on a forward stroke of the extraction cleaner 10 and to ease the resistance on a backward stroke of the extraction cleaner 10. For example, the agitation element 240 can define an agitation element axis B that intersects the plane P at an oblique angle A. The agitation element axis B can be defined by the bristles 242, a tuft of bristles 242, or a hole 292 supporting a tuft of bristles 242. In the case of the brush 38, the agitation element axis B can be defined by one of the tines, such that at least one of the tines, and alternatively multiple tines, are disposed at an oblique angle to the plane P, e.g., to the side skids 274, 276.

Referring to FIG. 12, in the embodiment shown, the brush mount 236 includes holes 292 that support tufts of bristles 242 (not shown in FIG. 12 for clarity). At least one of the holes 292, alternatively multiple holes 292, can define the bristle axis B at a center of the hole 292.

FIGS. 13-16C illustrate additional configurations of the handheld extraction cleaner 10 that include separator elements configured to substantially inhibit, block, obstruct, or impede, movement of water or other liquids into the fan 36, unintended movement of liquid out of the recovery tank 20, or both. These separator elements may work in conjunction with, or act as replacements for, the initial separator 24.

The separator elements operate to provide several possible benefits for the cleaner 10. The benefits may include, without limitation: keeping liquid (often debris filled) in the recovery tank 20 until it is disposed of through the tank outlet 118; limiting leaks caused by liquid moving outside of the recovery tank 20 into the forward end 58 of the housing 15; and/or limiting liquid from entering the suction source 18, which may impact operation of the vacuum motor 34. Note that the separator elements may be used in other configurations of the handheld extraction cleaner 10, including those with powered or spinning brush mechanisms.

Figure 13:
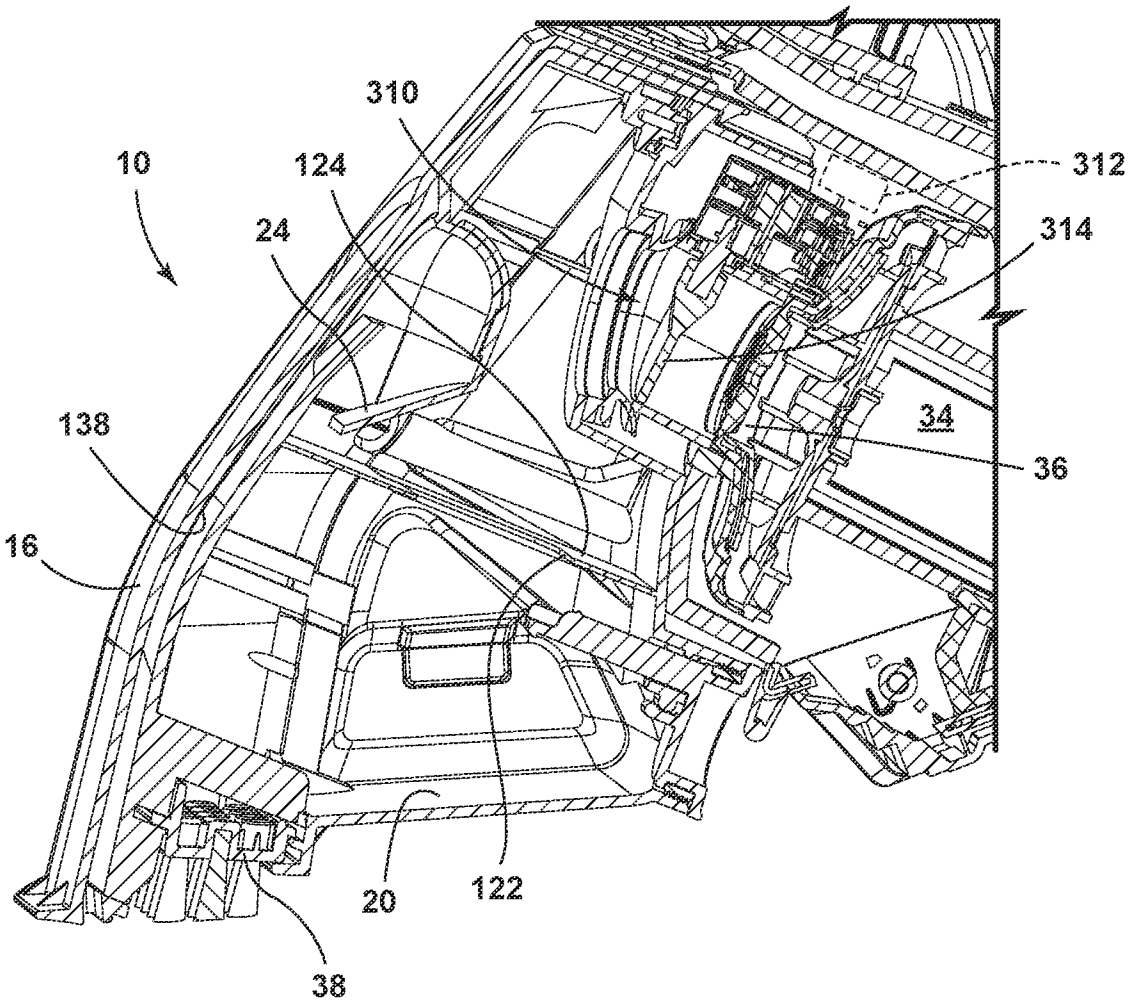
FIG. 13 is a cross-sectional view showing the forward portion of the handheld extraction cleaner, taken generally through line VI-VI of FIG. 1, with a butterfly valve acting as a separator element.

FIG. 13 schematically illustrates the separator element as an actuated butterfly valve 310, which is configured to selectively close the fan entrance. The butterfly valve 310 is configured to close when the handheld extraction cleaner 10 is moved into a particular orientation, such as sideways or upside down.

The butterfly valve 310 may have numerous control mechanisms, as recognized by those having ordinary skill in the art. One example control mechanism, without limitation, may utilize an orientation sensor 312 configured to sense an angle or position of the handheld extraction cleaner 10. The orientation sensor 312 is shown schematically in FIG. 13 and may be located elsewhere, as will be recognized by skilled artisans, such as within the remainder of the controls for the cleaner 10 or incorporated into the housing 15.

When the orientation sensor 312 determines that the position is outside of an operating zone range, the butterfly valve 310 is closed, such as by closing a valve element 314, which may be generally circular or otherwise shaped. However, when the position is within the operating zone range the butterfly valve 310 is open. Note that the operating zone range may include several aspects, including, without limitation: tilting or rolling about the longitudinal axis, angles about the transverse/lateral axis, other factors identifiable by those having ordinary skill in the art, or combinations thereof.

One example of the operating zone range may be illustrated with respect to the orientation shown in FIG. 3 and, also, in FIG. 11. FIG. 3 shows the handheld extraction cleaner 10 at a generally substantially horizontal angle relative to the surface to be cleaned. Note, however, that not all surfaces are substantially horizontal. In one example of intended operation, the handheld extraction cleaner 10 may generally be rotated approximately 45-degrees counterclockwise or approximately 90-degrees clockwise—with both rotation directions relative to the view and orientation shown in FIG. 3. Therefore, without limitation, in one aspect, the operating zone range may be considered relative to approximately 45-degrees counterclockwise, approximately 90-degrees clockwise, or any angle between 45-degrees and 90 degrees—with both rotation directions relative to the view and orientation shown in FIG. 3.

Additionally, with respect to rotation about the longitudinal axis, as best illustrated by comparing FIG. 8 to FIG. 9, the cleaner 10 may be rotated approximately 45-degrees in either direction and still be within the example operating zone range. It is understood that the operating zone range, with respect to both the clockwise/counterclockwise rotation directions relative to FIG. 3 and the rotation about the longitudinal axis relative to FIGS. 8 and 9 can be selected in concert based on a variety of factors, non-limiting examples of which include the intended use orientations, the size and shape of the recovery tank 20, and/or the relative configuration of the initial separator 24, the fan 36, and the specific separator element.

The orientation sensor 312 may work in conjunction with a dedicated butterfly controller, may be configured to directly control the butterfly valve 310, or another controller may actuate movement of the valve element 314 of the butterfly valve 310. The orientation sensor 312 may sense or measure any number of axes or positions relative thereto. Furthermore, the orientation sensor 312 may be formed from several types of components or devices, including, without limitation: an accelerometer, an inertial sensor, a tilt switch, a micro-electromechanical systems (MEMS) sensor, other devices recognizable by those having ordinary skill in the art, or combinations thereof.

The fan 36 may sound different to the user when the butterfly valve 310 is closed. In many configurations, when the butterfly valve 310 closes, the user will hear a higher pitch noise from the fan 36, as there will be limited airflow through the fan 36. This higher pitch noise instructs the user that the handheld extraction cleaner 10 is no longer within the operating zone range, such that the user may learn how to keep the cleaner 10 in the intended orientation. Furthermore, the butterfly valve 310 may be closed, or actuated shut, when the cleaner is turned off in order to mitigate liquid leakage during the off state.

Figure 14A:
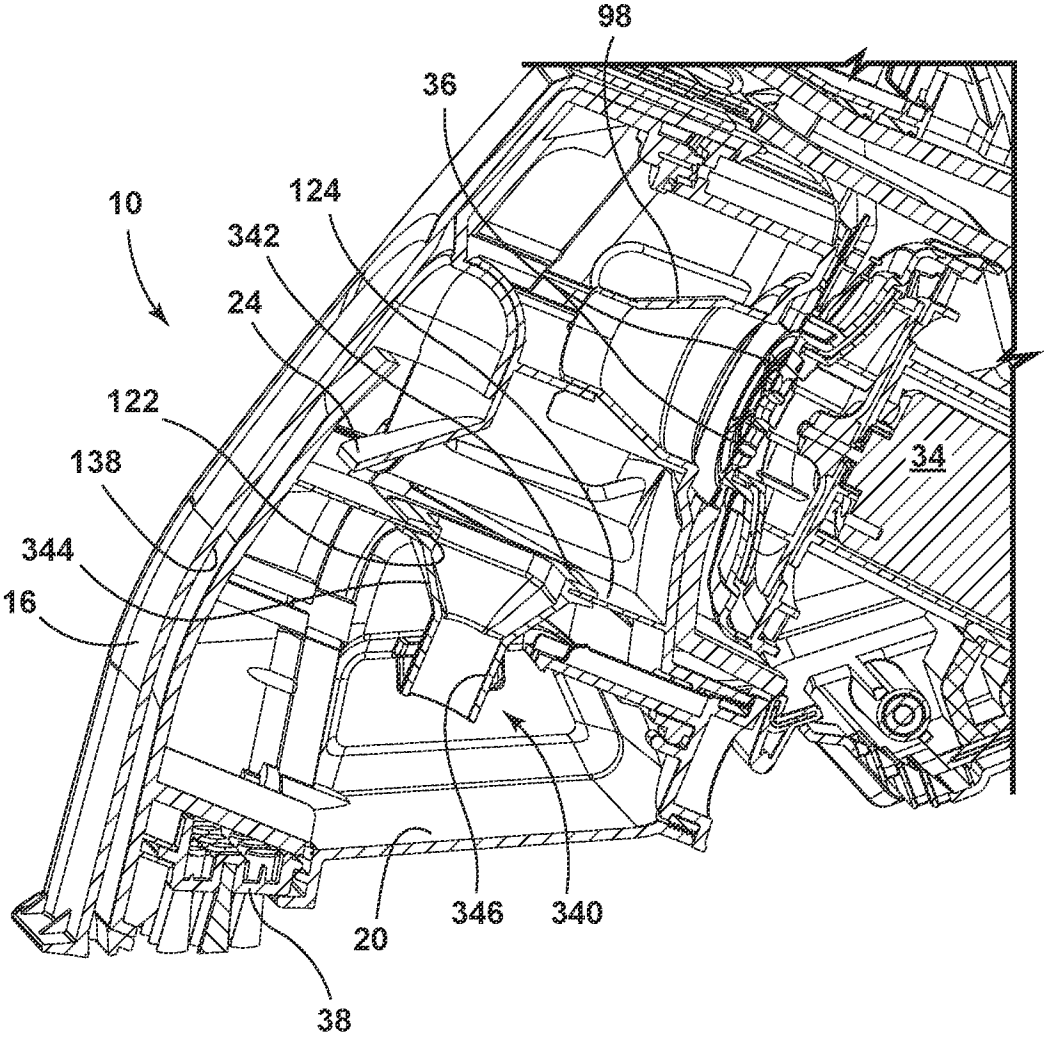
FIG. 14A is a cross-sectional view showing the forward portion of the handheld extraction cleaner, taken generally through line VI-VI of FIG. 1, with a funnel acting as a separator element.
Figure 14B:
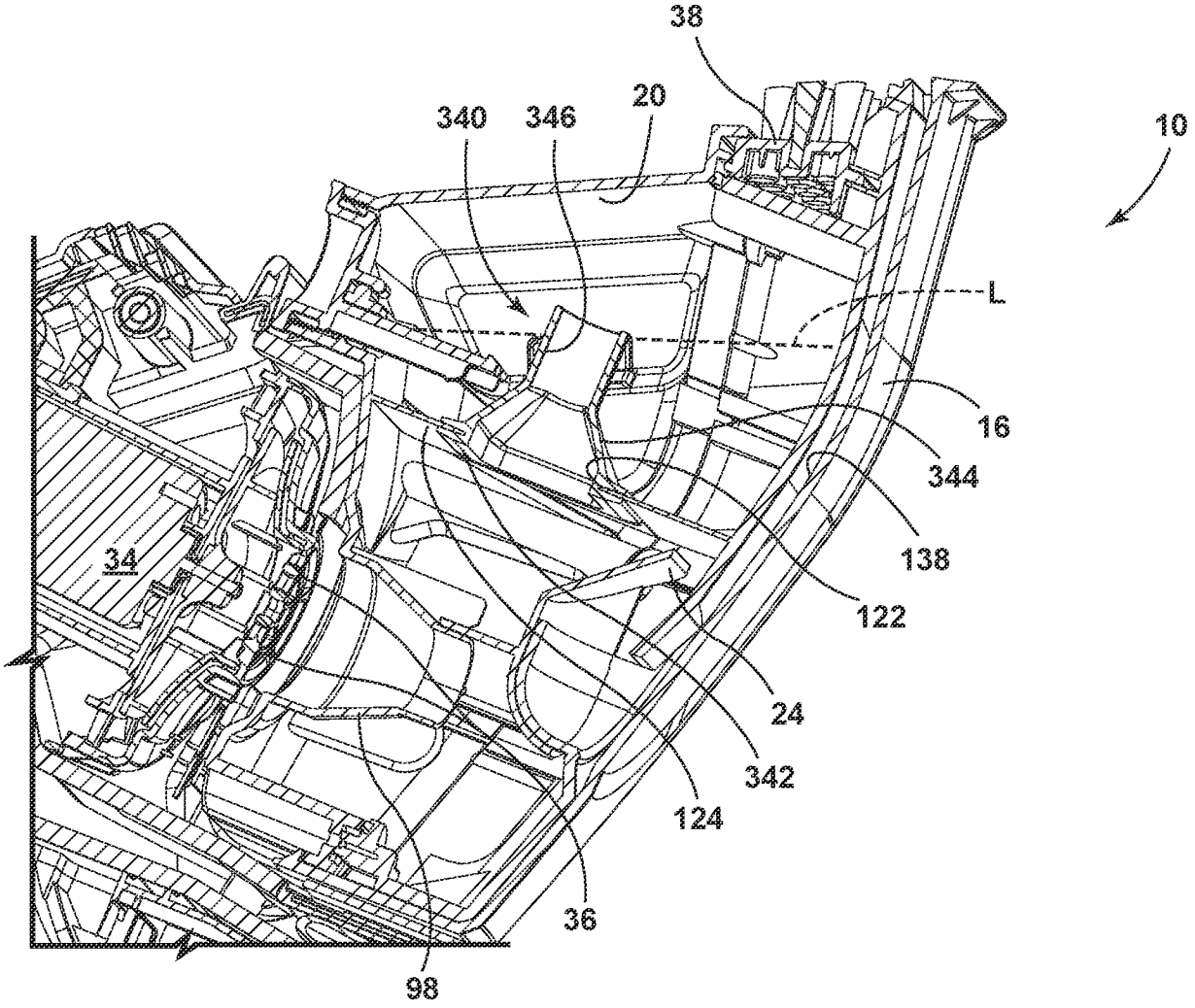
FIG. 14B is a cross-sectional view showing the forward portion of the handheld extraction cleaner, taken generally through line VI-VI of FIG. 1, with the funnel acting as the separator element, and the handheld extraction cleaner substantially upside down.

FIGS. 14A and 14B schematically illustrate the separator element as a funnel 340, which is configured to extend into the recovery tank 20. FIG. 14A shows the handheld extraction cleaner 10 in a generally preferred orientation and FIG. 14B shows the handheld extraction cleaner 10 substantially upside down. Therefore, the funnel 340 blocks liquid from leaving the recovery tank 20 during inversion, tilting, or other orientations outside of an operating zone range, of the handheld extraction cleaner 10.

The funnel 340 may include several elements to assist in allowing liquid to flow into the recovery tank 20 and to inhibit liquid from moving out of the recovery tank 20. For example, the funnel 340 may have a mount flange 342 configured to secure the funnel 340 within the tank opening 122 of the baffle wall 124. The mount flange 342 may further include one or more sealing elements, as recognized by skilled artisans.

Additional elements of the funnel 340 may include, without limitation, a funnel cone 344 and a funnel cylinder 346. The funnel cone 344 and the funnel cylinder 346 extend downward, relative to gravity in the normal use position, into the recovery tank 20, such that liquid is allowed to fall through the funnel 340 into the recovery tank 20.

However, when the cleaner 10 is oriented outside of the operating zone range, the funnel cone 344 and the funnel cylinder 346 limit the ability of liquid to move out of the recovery tank 20 by forming a barrier to liquid flow. Even when the recovery tank 20 is upside down, the funnel 340 may inhibit debris-filled liquid from flowing out of the recovery tank 20, particularly if the maximum fill quantity in the recovery tank 20 has not been exceeded. FIG. 14B illustrates the cleaner 10 turned substantially upside down. The highly exemplary liquid level L illustrates liquid within the recovery tank 20 in FIG. 14B. Note that the funnel cone 344 and the funnel cylinder 346 inhibit liquid from moving out of the recovery tank 20 toward the fan 36 or the suction nozzle 16.

Note that alternative structures for the funnel 340 may be used, such that liquid is limited from leaving the recovery tank 20 and flowing back into the area above the recovery tank 20 where the liquid may then flow into undesirable locations within the cleaner 10, such as the fan 36 or back into the nozzle 16. The dimensions of the funnel 340, including the dimensions of the funnel cone 344 and/or the funnel cylinder 346 may be selected based on factors such as the dimensions of the recovery tank 20, the intended max fill volume of the recovery tank 20, and/or the operating zone range.

In some cases, users may invert the cleaner 10 while moving it to empty the recovery tank 20 (for example, into a sink), as they are less likely to pay attention to the orientation of the cleaner 10 during such movement. The funnel 340 may be particularly beneficial during this time, as it limits movement of liquid out of the recovery tank 20 and into areas where liquid is not desired, such as the fan 36. Note, however, that the funnel 340 still retains an opening through which fluid may pass, such that shaking or jostling of the cleaner 10 may cause liquid to move out of the recovery tank 20 into an undesirable direction (such as toward the fan 36 or the suction nozzle 16).

Figure 15:
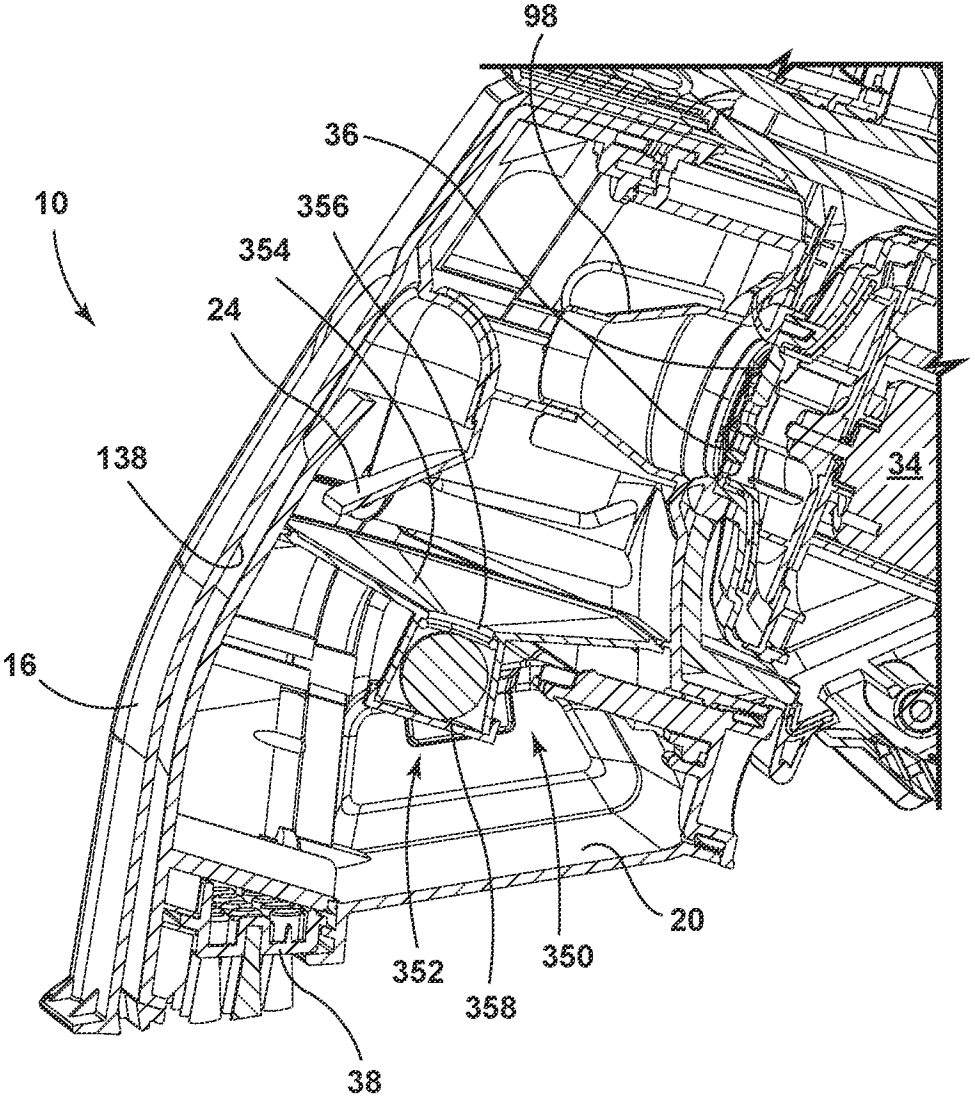
FIG. 15 is a cross-sectional view showing the forward portion of the handheld extraction cleaner, taken generally through line VI-VI of FIG. 1, with a funnel having a check valve acting as a separator element.

FIG. 15 schematically illustrates the separator element as a funnel 350, which is configured to extend into the recovery tank 20. The funnel 350 may be configured similar to the funnel 340 described above and illustrated in FIGS. 14A and 14B, but may include some differences, such as a check valve 352. To further limit egress of liquid from the recovery tank 20, some configurations of the cleaner 10 and the funnel 350 include the check valve 352, which is configured to generally allow fluid to flow substantially in only one direction—i.e., downward when the cleaner is oriented as shown in FIG. 3 or FIG. 15.

The funnel 350 includes a large funnel cone 354 that substantially replaces the baffle wall 124, but that feature is not limiting, such that the funnel 350 may also include the smaller funnel cone 344 of the funnel 340 illustrated in FIGS. 14A and 14B that the attaches to the baffle wall 124. Note that the funnel 350 and check valve 352 may be configured so as to not inhibit flow of liquids out of the recovery tank 20 when the cleaner is oriented within a predetermined operating zone range.

However, the check valve 352 may slow or inhibit the flow of liquid out of the recovery tank 20 through the funnel 350 compared to the flow of liquid in the absence of the check valve 352, even when the cleaner 10 is oriented within the predetermined operating zone range. In some examples, the funnel 350 and check valve 352 may be configured to inhibit the flow of liquid from the recovery tank 20 through the funnel 350 generally equally when the cleaner 10 is oriented within the predetermined operating zone range and outside the predetermined operating zone range. In other examples, the funnel 350 and check valve 352 may be configured to inhibit the flow of liquid from the recovery tank 20 through the funnel 350 to a greater extent when the cleaner 10 is oriented outside of the predetermined operating zone, as compared to within the predetermined operating zone range.

In the example of the funnel 350 shown, and without limitation, the check valve 352 is a ball or ball valve that is configured to close, and inhibit flow from the recovery tank 20 into the area above the recovery tank 20, when the handheld extraction cleaner 10 is outside of an operating zone range, such as when rotated upside down. The check valve 352 is configured to open, and allow flow into the recovery tank 20, when the handheld extraction cleaner 10 is within the operating zone range, such as the orientation shown in FIG. 15 to allow fluid and debris extracted during use of the cleaner 10 to be collected within the recovery tank 20.

The ball valve forming the check valve 352 will move toward an opening 356 of the funnel 350 when the cleaner 10 is out of the predetermined operating zone range, such that it blocks the opening 356 and inhibits the flow of liquid out of the recovery tank 20 through the funnel 350. In some configurations, the opening 356 may have an O-ring or other sealing device associated therewith to inhibit the flow of liquid out of the recovery tank 20 through the funnel 350.

As an alternative configuration, and without limitation, the check valve 352 may be formed by a flapper valve. The flapper valve may be substantially linear and is configured to close or block the opening 356, or some other portion of the funnel 350, when the cleaner 10 is inverted or rotated outside of the operating zone range.

A retaining element 358, illustrated as a cap, is configured to prevent or inhibit the ball from falling into the recovery tank 20. Other configurations may exist, such as an open slot in the funnel 350 or any configuration that prevents the ball from falling into the recovery tank 20. The retaining element 358 may have several drain elements formed therein to allow liquid to drain into the recovery tank 20, including, without limitation, holes or slots formed into the retaining element 358. Note that the drain elements may not be easily viewable in FIG. 15.

Figure 16A:
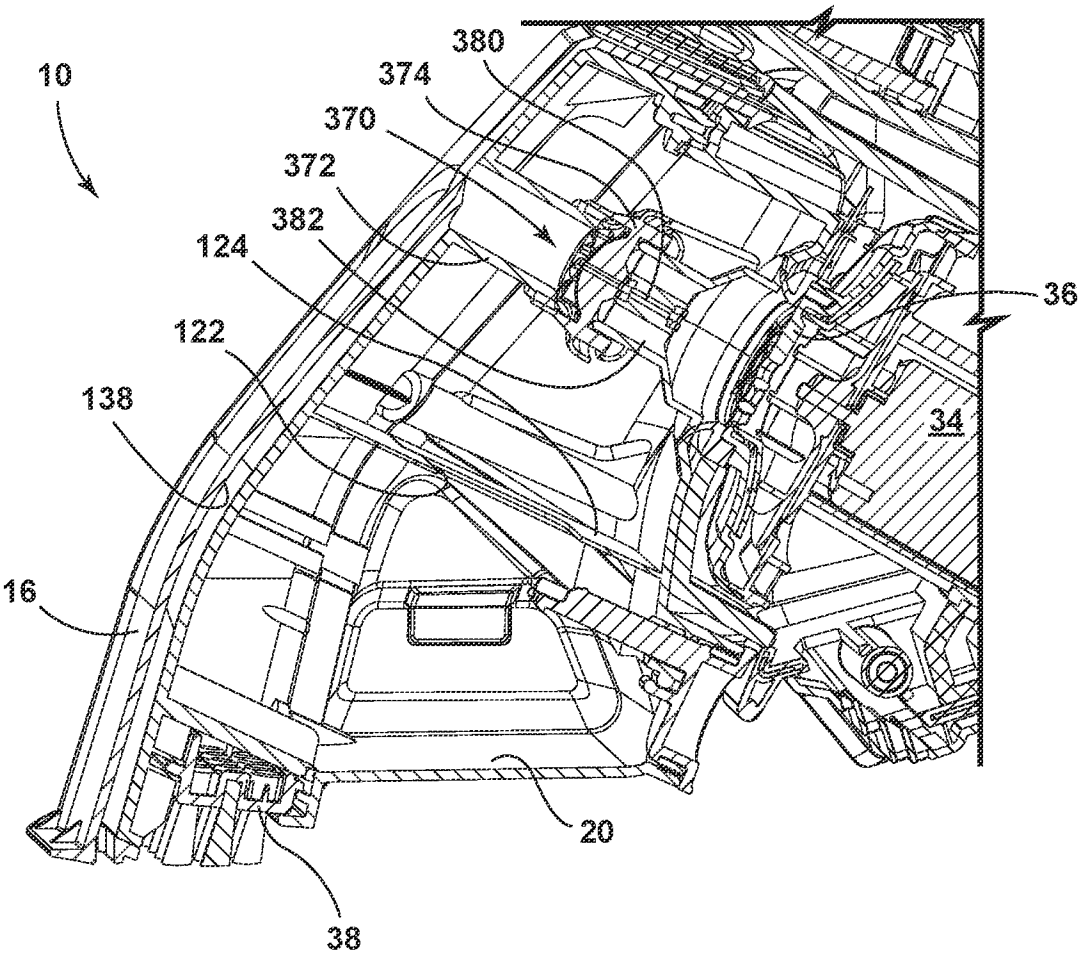
FIG. 16A is a cross-sectional view showing the forward portion of the handheld extraction cleaner, taken generally through line VI-VI of FIG. 1, with a fan separator acting as a separator element.
Figure 16C:
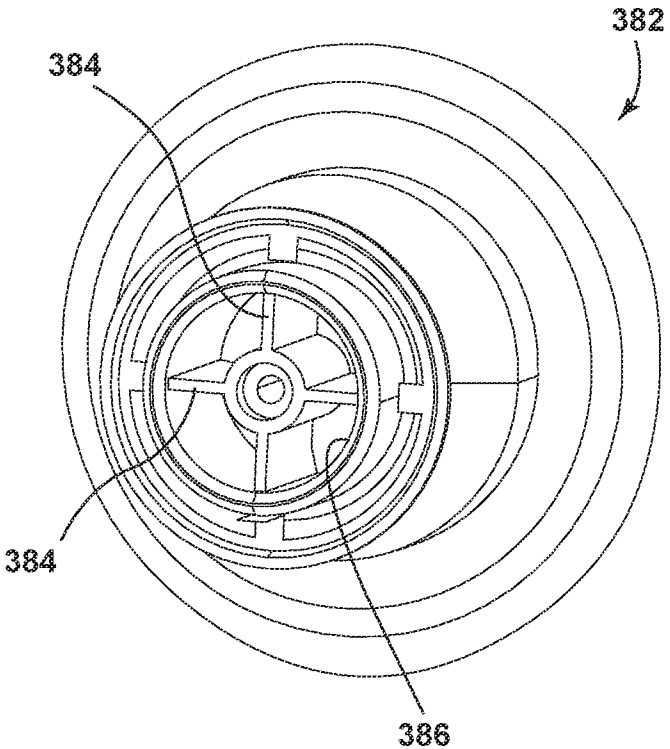
FIG. 16C is an enlarged isometric view of a spacer element for the fan separator shown in FIG. 16A.
Figure 16B:
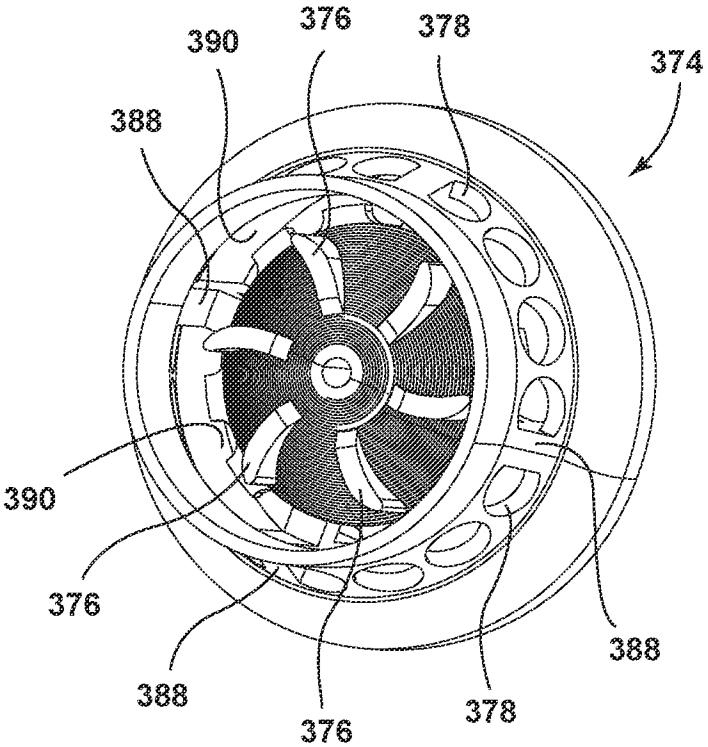
FIG. 16B is an enlarged isometric view of a spinning fan element for the fan separator shown in FIG. 16A.

FIGS. 16A, 16B, and 16C schematically illustrate the separator element as a fan separator 370, which is generally adjacent the suction fan 36. The fan separator 370 is configured to move, throw, or direct liquid outward, away from the fan separator 370. Additionally, the fan separator 370 is configured to limit liquids moving toward the fan entrance of the suction fan 36, and thus inhibit the flow of liquid toward the components of the suction source 18.

In this configuration of the handheld extraction cleaner 10, there is no initial separator 24, such as illustrated in FIGS. 13-15. Instead, the fan separator 370 sits in a similar location, near an exit conduit 372 of the suction nozzle 16, and between the suction nozzle 16 and the suction fan 36. As described above with respect to FIGS. 2-6, the suction source 18 is in fluid communication with the suction nozzle 16 for generating a working air stream containing fluid and debris. The fan separator 370 is disposed within the working air path and separates liquid and debris from the working air stream that is then collected within the recovery tank 20. The fan separator 370 is in fluid communication with the inlet of the suction fan 36 such that the working air separated from the working air stream can be exhausted through the exhaust vents 22 defining the clean air outlet.

The fan separator 370 has a spinning fan-like element or spinning fan element 374, which uses centrifugal force to direct liquids outward, and away from, the fan separator 370 and away from the suction fan 36. In this manner, the fan separator 370 separates liquid and debris from the working air stream, while still allowing the separated working air to travel to the suction fan 36 and eventually be exhausted through the exhaust vents 22. FIG. 16B shows an enlarged isometric view of the spinning fan element 374. A face of the fan element 374 may be grooved and spiraling outward to assist in moving liquid or debris away from the center of the fan separator 370. A plurality of separator blades 376 direct liquid outward through a plurality of holes 378, as best viewed in FIG. 16B.

The liquid and debris separated by the spinning fan element 374 is directed away from the fan separator 370 by the separator blades 376, such as through the holes 378 or other structures, including slots, into the remainder of the forward end 58 of the housing 15, as shown in FIGS. 1 and 3. The liquid and debris then pools, collects, and flows downward toward the recovery tank 20.

Skilled artisans will recognize numerous configurations for the spinning fan element 374 and the fan separator 370, in addition to the example configurations shown in FIG. 16A and FIG. 16B, that can centrifugally expel liquid and debris from the incoming working air stream containing a mixture of air, liquid, and debris. The working air, after liquid and debris is substantially separated therefrom, may pass through gaps or holes formed in the spinning fan element 374, through other passageways, or combinations thereof, to reach the suction fan 36 and be exhausted from the cleaner 10 through the exhaust vents 22. Without being limited by any theory, it is believed that in some cases, air that is expelled outward by the spinning fan element 374 will also be slowed before entering the passages to the suction fan 36, such that any remaining liquid/debris will likely drop out of the working air stream prior to reaching the suction fan 36 and other components of the suction source 18.

In the configuration shown, the fan separator 370 is driven by the vacuum motor 34. Therefore, the suction fan 36 and the fan separator 370 are driven by a common element, such as a shaft 380 extending from, or operatively connected to, the vacuum motor 34. Additionally, a spacer element 382 includes a central column configured to support the shaft 380. An enlarged view of the spacer element 382 is shown in FIG. 16C.

Around the central column, the spacer element 382 has X-shaped spacer walls 384 connecting to a cylinder, with hollow portions therebetween, such that air may pass through spacer gaps 386 in the spacer element 382 to the suction fan 36. The section view of FIG. 16A cuts through one of the X-shaped spacer walls 384 of the spacer element 382. However, the view of FIG. 16C better illustrates the X-shaped spacer walls 384.

As viewed in FIG. 16B, four X-shaped fan walls 388 of the spinning fan element 374 are visible. Also viewable in FIG. 16B are fan gaps 390 through which separated working air may flow through the spinning fan element 374, through the spacer gaps 386 in the spacer element 382, and toward the suction fan 36.

Configurations having either the butterfly valve 310 or the fan separator 370 may further include a funnel element extending into the recovery tank 20, such as the funnel 340 or the funnel 350. Additionally, strainers may be used to limit the size of debris exiting the suction nozzle 16, such that any of the separator elements are less subject to large debris.

To assist and clarify the description of various embodiments, various terms may be defined herein. Unless otherwise indicated, the following definitions apply throughout this specification (including the claims). Additionally, all references referred to are incorporated herein in their entirety.

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

When used, the term "substantially" refers to relationships that are ideally perfect or complete, but where manufacturing realties prevent absolute perfection. Therefore, substantially denotes typical variance from perfection. For example, if height A is substantially equal to height B, it may be preferred that the two heights are 100.0% equivalent, but manufacturing realities likely result in the distances varying from such perfection. Skilled artisans will recognize the amount of acceptable variance. For example, and without limitation, coverages, areas, or distances may generally be within 10% of perfection for substantial equivalence. Similarly, relative alignments, such as parallel or perpendicular, may generally be considered to be within 5%.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one, and all, combinations of the associated listed items. The term "any of" is understood to include any possible combination of referenced items, including "any one of" the referenced items.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

Clauses follow.

1. A handheld extraction cleaner, including: a suction nozzle defining an inlet path; a suction fan configured to provide suction to the inlet path, such that the inlet path brings liquid and air into the handheld extraction cleaner, wherein the suction fan has a fan entrance; a recovery tank spaced from the fan entrance; and a separator element configured to allow liquid to flow into the recovery tank, inhibit the flow of liquid out of the recovery tank, and inhibit liquid from reaching the fan entrance, or all three.
2. The handheld extraction cleaner of any clause, wherein the separator element is a butterfly valve configured to selectively close the fan entrance.
3. The handheld extraction cleaner of any clause, further comprising: an orientation sensor configured to sense an angle of the handheld extraction cleaner, wherein the orientation sensor is configured to close the butterfly valve when the sensed angle is outside of an operating zone range and is configured to open the butterfly valve when the sensed angle is within the operating zone range.
4. The handheld extraction cleaner of any clause, wherein the separator element is a funnel, and wherein the funnel extends into the recovery tank, such that the funnel blocks liquid from leaving the recovery tank during operation outside of an operating zone range of the handheld extraction cleaner.
5. The handheld extraction cleaner of any clause, further comprising: a check valve within the funnel, wherein the check valve is configured to close, and inhibit flow from the recovery tank, when the handheld extraction cleaner is outside of an operating zone range and is configured to open, and allow flow into the recovery tank, when the handheld extraction cleaner is within the operating zone range.
6. The handheld extraction cleaner of any clause, wherein the check valve is a ball valve or a flapper valve.
7. The handheld extraction cleaner of any clause, wherein the separator element is a fan separator adjacent the suction fan, and wherein the fan separator directs liquid outward, away from the fan separator, within the handheld extraction cleaner, such that liquid is moved away from the suction fan.
8. The handheld extraction cleaner of any clause, wherein the fan separator and the suction fan are driven by a common element.
9. A handheld extraction cleaner, including: a suction nozzle defining an inlet path; a brush element disposed adjacent one end of the inlet path; a suction fan configured to provide suction to an opposite end of the inlet path from the brush element, such that the inlet path brings liquid and air into the handheld extraction cleaner, wherein the suction fan has a fan entrance; a vacuum motor operatively driving the suction fan; a recovery tank having a tank inlet spaced from the fan entrance; and a separator element configured to allow liquid to flow into the recovery tank, inhibit the flow of liquid out of the recovery tank, and inhibit liquid from reaching the fan entrance, or all three.
10. The handheld extraction cleaner of any clause, wherein the separator element is a funnel located at the tank inlet of the recovery tank, and wherein the funnel extends from the tank inlet into the recovery tank, such that the funnel blocks liquid from leaving the recovery tank during operation outside of an operating zone range of the handheld extraction cleaner.

11. The handheld extraction cleaner of any clause, further comprising: a check valve within the funnel, wherein the check valve is configured to close and inhibit flow from the recovery tank when the handheld extraction cleaner is outside of an operating zone range and is configured to open, and allow flow into the recovery tank, when the handheld extraction cleaner is within the operating zone range.

12. The handheld extraction cleaner of any clause, wherein the check valve is a ball valve or a flapper valve.

13. The handheld extraction cleaner of any clause, wherein the separator element is a fan separator adjacent the suction fan, and wherein the fan separator directs liquid outward, away from the fan separator, within the handheld extraction cleaner, such that liquid is moved away from the suction fan.

14. The handheld extraction cleaner of any clause, wherein the fan separator and the suction fan are commonly driven by the vacuum motor.

15. The handheld extraction cleaner of any clause, further comprising: a funnel located at the tank inlet of the recovery tank, and wherein the funnel extends from the tank inlet into the recovery tank, such that the funnel blocks liquid from leaving the recovery tank during operation outside of an operating zone range of the handheld extraction cleaner.

16. The handheld extraction cleaner of any clause, wherein the separator element is a butterfly valve configured to selectively close the fan entrance.

17. The handheld extraction cleaner of any clause, further comprising: an orientation sensor configured to sense an angle of the handheld extraction cleaner, wherein the orientation sensor is configured to close the butterfly valve when the sensed angle is outside of an operating zone range and is configured to open the butterfly valve when the sensed angle is within the operating zone range.

18. The handheld extraction cleaner of any clause, further comprising: a funnel located at the tank inlet of the recovery tank, and wherein the funnel extends from the tank inlet into the recovery tank, such that the funnel blocks liquid from leaving the recovery tank during operation outside of an operating zone range of the handheld extraction cleaner.

What is claimed is:

1. A handheld extraction cleaner, comprising:

a suction nozzle defining an inlet path;

a suction fan configured to provide suction to the inlet path, such that the inlet path brings liquid and air into the handheld extraction cleaner, wherein the suction fan has a fan entrance;

a recovery tank spaced from the fan entrance; and a separator element configured to allow liquid to flow into the recovery tank, and/or to inhibit the flow of liquid out of the recovery tank, and/or to inhibit liquid from reaching the fan entrance;

wherein the separator element is a fan separator adjacent the suction fan, and wherein the fan separator directs liquid outward, away from the fan separator, within the handheld extraction cleaner, such that liquid is moved away from the suction fan.

2. The handheld extraction cleaner of claim 1, wherein the fan separator and the suction fan are driven by a common element.

3. The handheld extraction cleaner of claim 1, further comprising:

a funnel located at a tank inlet of the recovery tank, and wherein the funnel extends from the tank inlet into the recovery tank, such that the funnel blocks liquid from leaving the recovery tank during operation outside of an operating zone range of the handheld extraction cleaner.

4. The handheld extraction cleaner of claim 1, wherein the fan separator includes a fan element having separator blades and defining a plurality of holes; and wherein the separator blades are configured to direct liquid away from a center of the fan separator and outward by centrifugal force through the plurality of holes.

5. The handheld extraction cleaner of claim 4, further comprising:

a vacuum motor;

a shaft extending from or operatively connected to the vacuum motor;

wherein the suction fan and the fan separator are commonly driven by the vacuum motor via the shaft.

6. The handheld extraction cleaner of claim 5, further comprising:

a spacer element having a central column configured to support the shaft.

7. The handheld extraction cleaner of claim 6, wherein the spacer element includes spacer walls and a cylinder; and wherein the spacer walls extend from the central column to the cylinder and define spacer gaps between the spacer walls such that air may pass through the spacer gaps to the suction fan.

8. The handheld extraction cleaner of claim 7, wherein there are four spacer walls defining an X shape.

9. The handheld extraction cleaner of claim 7, wherein the separator element defines fan gaps arranged such that working air flows through the fan gaps to the spacer gaps of the spacer element and toward the suction fan.

10. A handheld extraction cleaner, comprising:

a suction nozzle defining an inlet path;

a brush element disposed adjacent one end of the inlet path;

a suction fan configured to provide suction to an opposite end of the inlet path from the brush element, such that the inlet path brings liquid and air into the handheld extraction cleaner, wherein the suction fan has a fan entrance;

a vacuum motor operatively driving the suction fan;

a recovery tank having a tank inlet spaced from the fan entrance; and a separator element configured to allow liquid to flow into the recovery tank and/or inhibit liquid from reaching the fan entrance;

wherein the separator element is a fan separator adjacent the suction fan, and wherein the fan separator directs liquid outward, away from the fan separator, within the handheld extraction cleaner, such that liquid is moved away from the suction fan.

11. The handheld extraction cleaner of claim 10, wherein the fan separator and the suction fan are commonly driven by the vacuum motor.

12. The handheld extraction cleaner of claim 10, further comprising:

a funnel located at the tank inlet of the recovery tank, and wherein the funnel extends from the tank inlet into the recovery tank, such that the funnel blocks liquid from leaving the recovery tank during operation outside of an operating zone range of the handheld extraction cleaner.

13. The handheld extraction cleaner of claim 10, wherein the fan separator includes a fan element having separator blades and defining a plurality of holes; and wherein the separator blades are configured to direct liquid away from a center of the fan separator and outward by centrifugal force through the plurality of holes.

14. The handheld extraction cleaner of claim 13, further comprising:

a shaft extending from or operatively connected to the vacuum motor;

wherein the suction fan and the fan separator are driven by the vacuum motor via the shaft.

15. The handheld extraction cleaner of claim 14, further comprising:

a spacer element having a central column configured to support the shaft.

16. The handheld extraction cleaner of claim 15, wherein the spacer element includes spacer walls and a cylinder; and wherein the spacer walls extend from the central column to the cylinder and define spacer gaps between the spacer walls such that air may pass through the spacer gaps to the suction fan.

17. The handheld extraction cleaner of claim 16, wherein there are four spacer walls defining an X shape.

18. The handheld extraction cleaner of claim 16, wherein the separator element defines fan gaps arranged such that working air flows through the fan gaps to the spacer gaps of the spacer element and toward the suction fan.

* * * * *